US009873268B2

(12) United States Patent
Goto

(10) Patent No.: US 9,873,268 B2
(45) Date of Patent: Jan. 23, 2018

(54) PRINTER CAPABLE OF PROVIDING IMPROVED CONVEYING PERFORMANCE FOR CONVEYING PRINTING MEDIUM

(71) Applicant: Brother Kogyo Kabushiki Kaisha, Nagoya-shi, Aichi-ken (JP)

(72) Inventor: Takashi Goto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/173,830

(22) Filed: Jun. 6, 2016

(65) Prior Publication Data

US 2017/0021644 A1 Jan. 26, 2017

(30) Foreign Application Priority Data

Jul. 24, 2015 (JP) ..... 2015-146466

(51) Int. Cl.

| | |
|---|---|
| ***B41J 11/04*** | (2006.01) |
| ***B41J 2/32*** | (2006.01) |
| ***B41J 13/30*** | (2006.01) |
| ***B41J 25/308*** | (2006.01) |

(52) U.S. Cl.

CPC ..... *B41J 11/04* (2013.01); *B41J 2/32* (2013.01); *B41J 13/30* (2013.01); *B41J 25/308* (2013.01)

(58) Field of Classification Search

CPC ..... B41J 11/04; B41J 2/32

See application file for complete search history.

(56) References Cited

U.S. PATENT DOCUMENTS

2005/0200690 A1* 9/2005 Matsukawa ..... B41J 2/32 347/179

FOREIGN PATENT DOCUMENTS

| | | |
|---|---|---|
| JP | H09-216393 A | 8/1997 |
| JP | 2014-008620 A | 1/2014 |

* cited by examiner

*Primary Examiner* — Alessandro Amari
*Assistant Examiner* — Roger W Pisha, II
(74) *Attorney, Agent, or Firm* — Banner & Witcoff, Ltd.

(57) ABSTRACT

A printer includes: a head; a platen roller; a support member supporting the head; a moving mechanism configured to move the support member between a nipping position and a separated position; a positioning member; and a displaceable member. The positioning member has a prescribed portion that contacts a printing medium nipped between the head and the platen roller. The positioning member positions the printing medium in a perpendicular direction perpendicular to a conveying direction of the printing medium. The prescribed portion and the head provide an imaginary straight line extending therebetween when the head is at a position that nips the printing medium in cooperation with the platen roller. The displaceable member supported by the support member moves along a prescribed path in conjunction with a movement of the support member between the nipping position and the separated position. The prescribed path intersects the imaginary straight line.

11 Claims, 12 Drawing Sheets

PRINTER CAPABLE OF PROVIDING IMPROVED CONVEYING PERFORMANCE FOR CONVEYING PRINTING MEDIUM

CROSS REFERENCE TO RELATED APPLICATION

This application claims priority from Japanese Patent Application No. 2015-146466 filed Jul. 24, 2015. The entire content of the priority application is incorporated herein by reference.

TECHNICAL FIELD

The present disclosure relates to a printer for printing one or more characters such as letters, figures, numerals, symbols, and the like on a printing medium.

BACKGROUND

There is conventionally known a printer that prints one or more characters on a printing medium. Specifically, Japanese Patent Application Publication No. H9-216393 discloses a printer that prints an image on a film as a printing medium. This printer includes a thermal head, a platen roller, and a guide. The thermal head is arranged to face the platen roller. The guide is positioned upstream of the thermal head and the platen roller in a conveying direction of the film. The guide linearly extends toward a contact position between the thermal head and the platen roller. The film guided by the guide is nipped between the thermal head and the platen roller, and an image is printed on the film while the film is conveyed in the conveying direction.

SUMMARY

However, according to the above-described printer, a contacting area of the film to be in contact with the platen roller would be reduced, since the guide extends linearly toward the contacting position between the thermal head and the platen roller. Accordingly, the platen roller may not transmit a sufficient conveying force to the film, causing degradation of conveying performance to the film. A simple structure is required for improvement on conveying performance because various parts and components are provided around the thermal head and the platen roller.

In view of the foregoing, it is an object of the disclosure to provide a printer having a simple construction, yet capable of improving conveying performance to a printing medium nipped between a head and a platen roller.

In order to attain the above and other objects, according to one aspect, the disclosure provides a printer including: a head; a platen roller; a support member; a moving mechanism; a positioning member; and a displaceable member. The head is configured to print one or more characters on a printing medium. The platen roller is configured to nip the printing medium in cooperation with the head to convey the printing medium in a conveying direction. The support member supports the head. The moving mechanism is configured to move the support member between a nipping position and a separated position. The support member at the nipping position allows the head to nip the printing medium in cooperation with the platen roller. The support member at the separated position allows the head to be positioned farther from the platen roller than the head from the platen roller at the nipping position. The positioning member is positioned upstream relative to the platen roller in the conveying direction. The positioning member has a prescribed portion configured to contact the printing medium conveyed and nipped between the head and the platen roller. The positioning member is configured to fix a position of the printing medium with respect to a perpendicular direction that is perpendicular to the conveying direction. The prescribed portion and the head provide an imaginary straight line extending therebetween when the head is at a position that nips the printing medium in cooperation with the platen roller. The displaceable member is supported by the support member and configured to move along a prescribed path in conjunction with a movement of the support member between the nipping position and the separated position. The prescribed path intersects the imaginary straight line.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
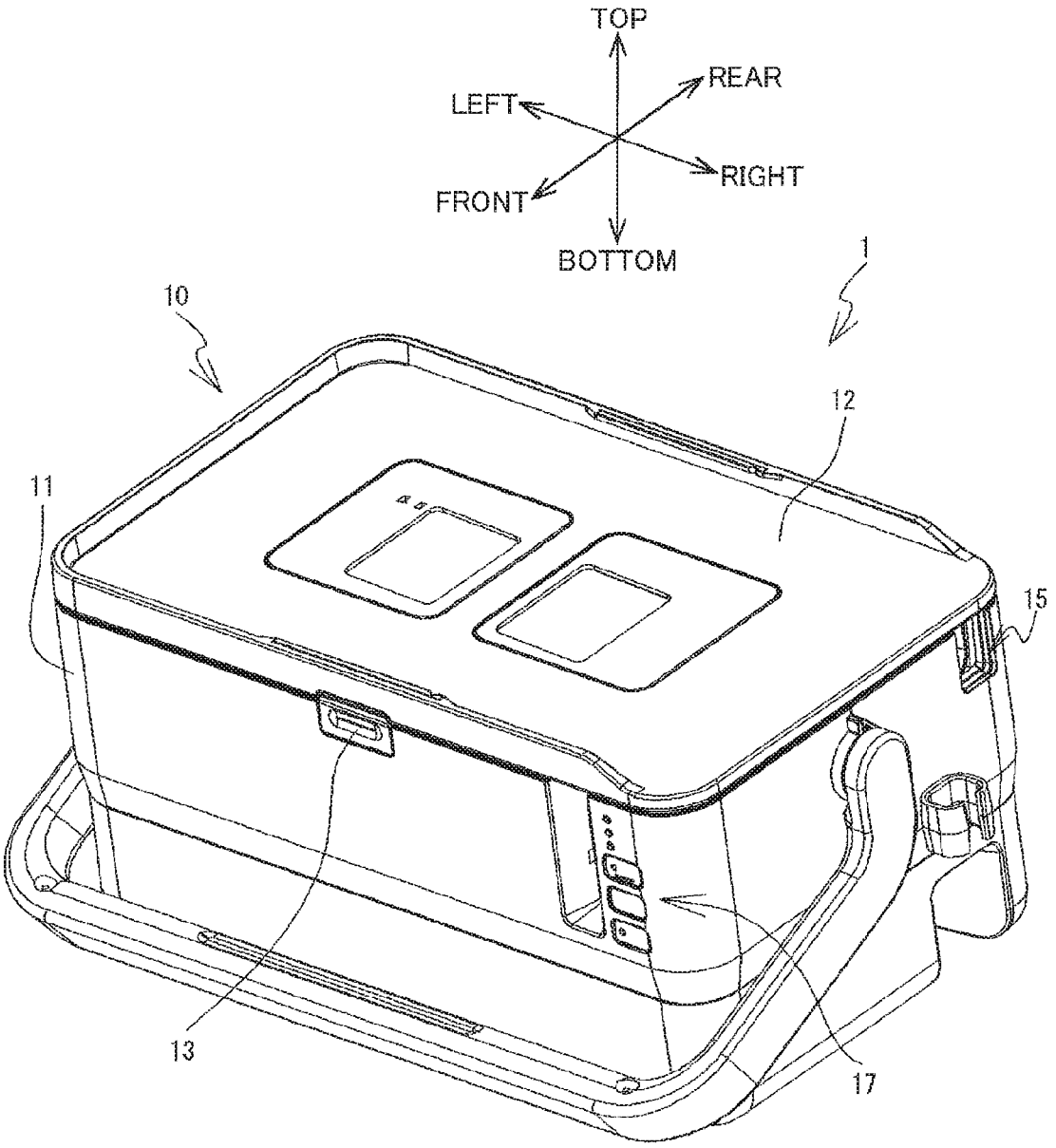
FIG. 1 is a perspective view of a printer 1 according to one embodiment in which a cover 12 is closed.

1. Overview of Structure of Printer 1

A printer 1 according to one embodiment will be described with reference to the accompanying drawings, wherein like parts and components are designated by the same reference numerals to avoid duplicating description.

The printer 1 is configured to print one or more characters (letters, figures, numerals, symbols, and the like) on a tubular member 9 (FIG. 9) as an example of a printing medium.

Direction in the following description related to the printer 1 will be given based on arrows illustrated in FIG. 1. Specifically, a top side, a bottom side, an upper-left side, a lower-right side, a lower-left side, and an upper-right side in FIG. 1 will be referred to as a top side, a bottom side, a left side, a right side, a front side, and a rear side of the printer 1, respectively.

As illustrated in FIG. 1, the printer 1 is provided with a housing 10 including a body casing 11 and a cover 12. The body casing 11 has a box shape. More specifically, the body casing 11 is in the form of a rectangular parallelepiped that is elongated in a left-right direction. The cover 12 is positioned above the body casing 11 and has a plate shape. The cover 12 has a rear end portion pivotally movably supported to an upper-rear end portion of the body casing 11. A locking mechanism 13 is provided at an upper-front end portion of the body casing 11. The locking mechanism 13 is adapted to engage with a front end portion of the cover 12 in a closing posture of the cover 12 relative to the body casing 11 to restrain inadvertent opening of the cover 12.

A receiving surface 11A (FIG. 2) is provided constituting an upper surface of the body casing 11. The cover 12 covers the receiving surface 11A when the cover 12 is closed relative to the body casing 11 (FIG. 1). When a user opens the cover 12, the user operates the locking mechanism 13 to release engagement with the cover 12, and pivotally moves the cover 12 upward away from the locking mechanism 13. In an opening posture of the cover 12 relative to the body casing 11, the receiving surface 11A is exposed to an outside so that the user can be accessed to the receiving surface 11A from above.

The housing 10 has an operating portion 17, a tube inlet opening 15, and a tube outlet opening 16 (FIG. 2) at its side walls. The operating portion 17 includes a plurality of buttons such as a power button and a start button. The operating portion 17 also permits the user to select one of a "small nipping force", an "intermediate nipping force" and a "large nipping force" described later. The operating portion 17 is provided at an upper-right portion of a front wall of the body casing 11. The tube inlet opening 15 is adapted to guide the tubular member 9 toward an interior of the housing 10. The tube inlet opening 15 is positioned at an upper-rear portion of a right side wall of the body casing 11, and has a rectangular shape that is elongated in a vertical direction. The tube outlet opening 16 is adapted to guide the tubular member 9 toward an exterior of the housing 10. The tube outlet opening 16 is positioned at an upper-rear portion of a left side wall of the body casing 11, and has a rectangular shape that is elongated in the vertical direction. The tube outlet opening 16 is positioned slightly forward of the tube inlet opening 15 in a front-rear direction.

Figure 2:
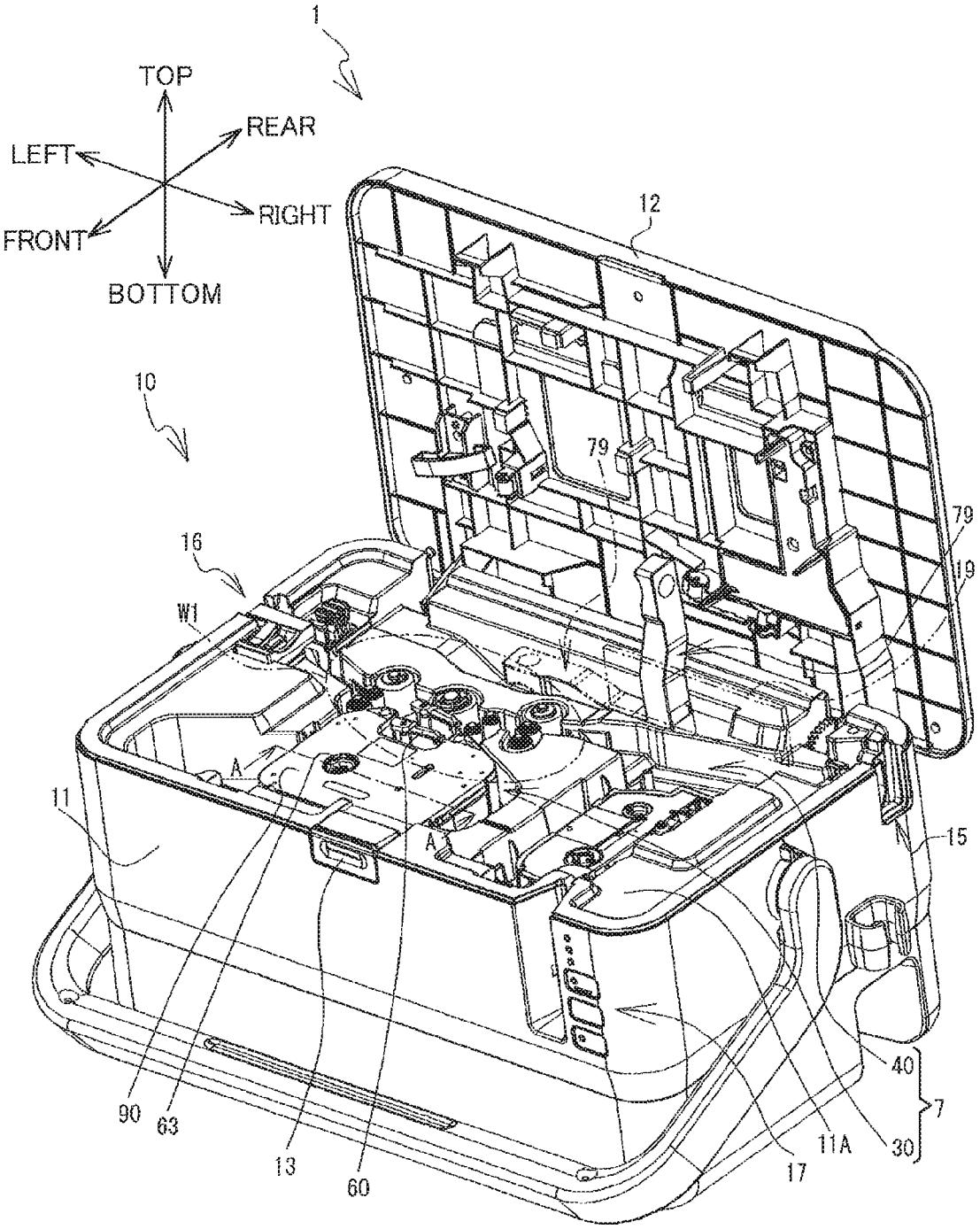
FIG. 2 is a perspective view of the printer 1 according to the embodiment in which the cover 12 is open.
Figure 5:
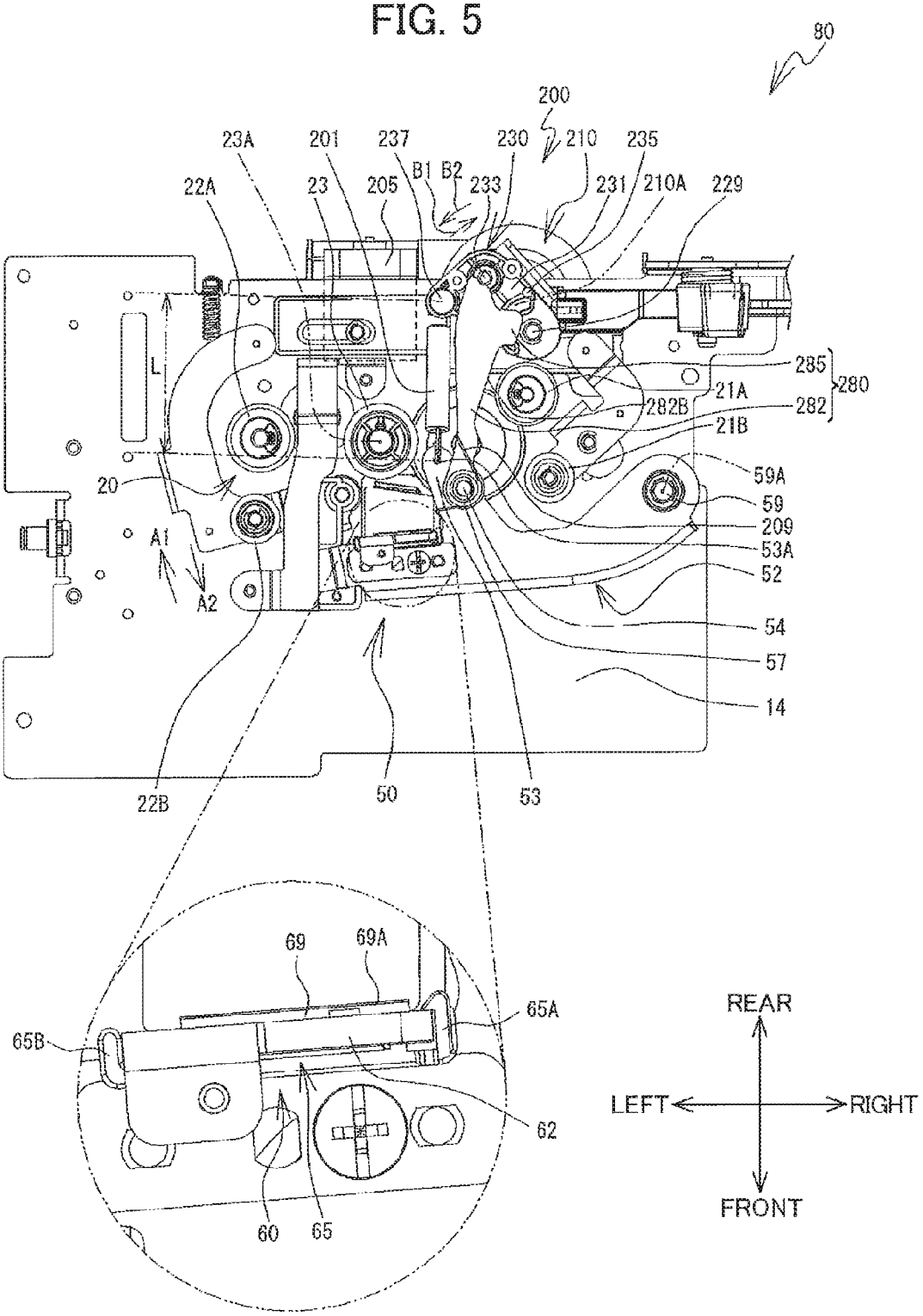
FIG. 5 is a plan view of the printing mechanism 80 in which a support member 52 is at a separated position.

As illustrated in FIG. 2, a receiving portion 7 including a tube receiving portion 40 and a ribbon receiving portion 30 is formed at the receiving surface 11A. The receiving portion 7 is in the form of a recess opening upward. The receiving portion 7 has a bottom wall portion positioned above and facing a bottom wall portion of the body casing 11 through a support plate 14 (FIG. 5). The support plate 14 is a plate-like member positioned above the bottom wall portion of the body casing 11 and extending in the left-right direction and the front-rear direction.

The tubular member 9 (FIG. 9) is attachable to and detachable from the tube receiving portion 40. The tube receiving portion 40 extends from the tube inlet opening 15 to a position adjacent to a right side portion of the tube outlet opening 16. The tube receiving portion 40 generally extends in the left-right direction, but is slightly inclined forward toward a left side thereof, because the tube outlet opening 16 is positioned slightly forward relative to the tube inlet opening 15 in the front-rear direction.

A direction in which the tube receiving portion 40 extends from the tube inlet opening 15 toward the tube outlet opening 16 will be referred to as a "tube conveying direction". The tube conveying direction is in parallel to the left-right direction, and perpendicular to the vertical direction and the front-rear direction. The tubular member 9 is attached to the tube receiving portion 40 by the user such that the tubular member 9 extends in the tube conveying direction from the tube inlet opening 15 to the tube outlet opening 16. The attached tubular member 9 is conveyed in the tube conveying direction. A side where the tube outlet opening 16 is positioned relative to the tube inlet opening 15 in the tube conveying direction will be referred to as a downstream side in the tube conveying direction, while a side where the tube inlet opening 15 is positioned relative to the tube outlet opening 16 in the tube conveying direction will be referred to as an upstream side in the tube conveying direction.

The tube receiving portion 40 provides an open space having a cross-sectional area extending in a direction perpendicular to the tube conveying direction. This cross-sectional area is slightly greater than a cross-sectional area of the tubular member 9 except for a central portion of the tube receiving portion 40 in the tube conveying direction. The cross-sectional area of the tubular member 9 is a transverse plane perpendicular to a direction in which the tubular member 9 extends.

A ribbon cassette 90 is attachable to and detachable from the ribbon receiving portion 30. The ribbon receiving portion 30 provides an open space whose profile generally corresponds to a profile of the ribbon cassette 90 in a plan view. The ribbon receiving portion 30 is positioned at a left front portion of the receiving surface 11A. The ribbon receiving portion 30 is positioned forward of the tube receiving portion 40.

The open space of the tube receiving portion 40 has a front end portion at the central portion in the tube conveying direction, and the front end portion of the open space of the tube receiving portion 40 is in communication with a rear end portion of the open space of the ribbon receiving portion 30. The space providing communication between the tube receiving portion 40 and the ribbon receiving portion 30 will be referred to as a communication space 8. A communication hole (not illustrated) is formed in the bottom wall portion of the receiving portion 7 at a position below the communication space 8. The communication hole is generally rectangular in shape in a plan view, and penetrates the bottom wall portion of the receiving portion 7 in the vertical direction. The communication hole is positioned above a central portion of the support plate 14 (FIG. 5) in the left-right direction and the front-rear direction.

As illustrated in FIG. 2, a board 19 is provided at a right rear portion in an interior of the body casing 11. The board 19 extends in the vertical direction and the left-right direction. The board 19 is provided with a CPU, a ROM and a RAM, those not illustrated. The CPU is adapted to control operations of the printer 1.

Figure 3:
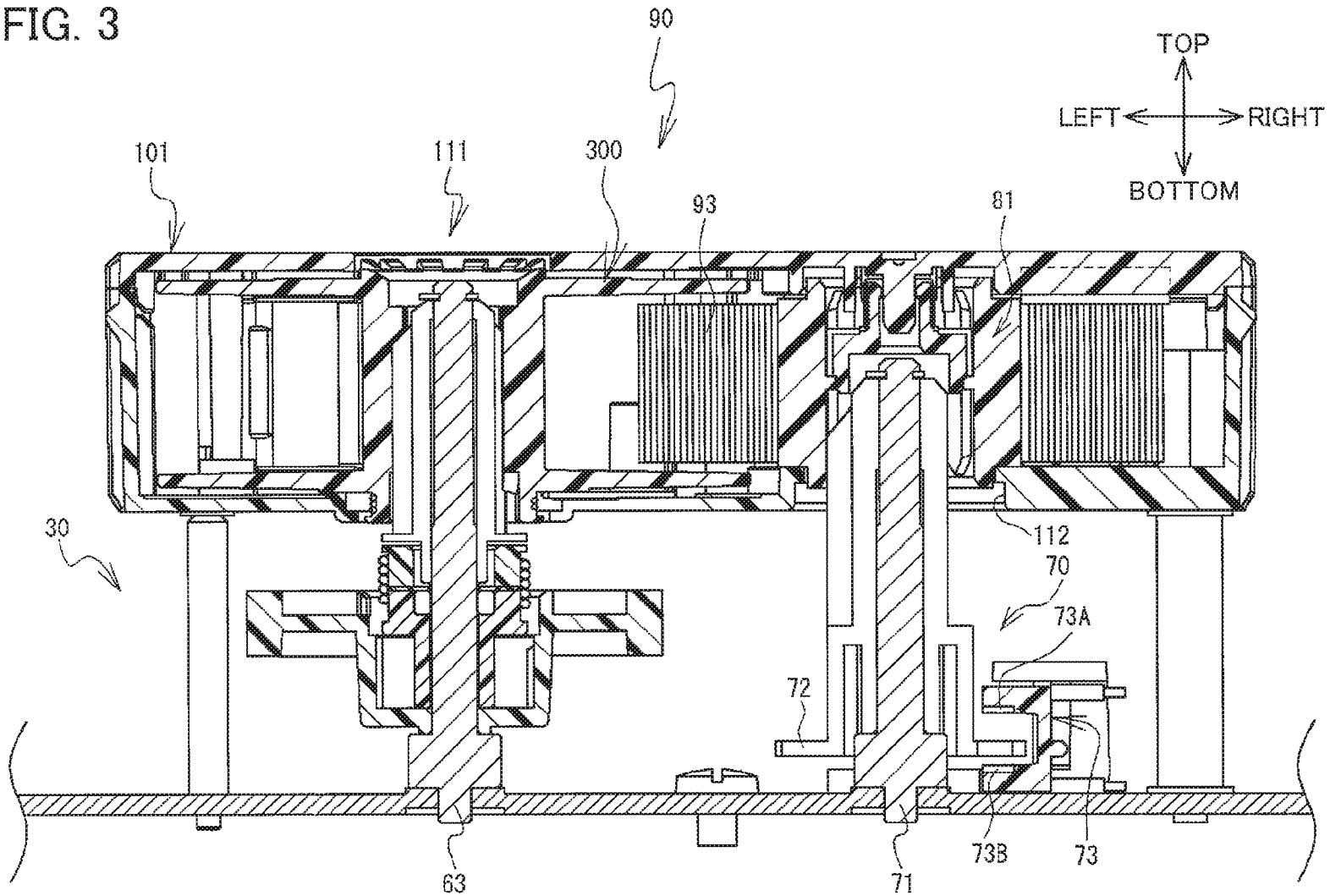
FIG. 3 is a cross-sectional view of a ribbon cassette 90 attached to the printer 1 according to the embodiment taken along a line A-A in FIG. 2.

As illustrated in FIG. 3, the ribbon cassette 90 is attachable to the ribbon receiving portion 30. The ribbon cassette 90 includes a case 101, a ribbon spool 81, and a winding spool 300. The case 101 has a box-like configuration in which the ribbon spool 81 and the winding spool 300 are accommodated. The ribbon spool 81 and the winding spool 300 are generally cylindrical extending in the vertical direction. The ribbon spool 81 is positioned rightward of the winding spool 300. The winding spool 300 and the ribbon spool 81 are supported by a first support bore 111 and a second support bore 112 formed in the case 101, respectively, and are rotatable about axes extending in the vertical direction. The first support bore 111 is supported by a ribbon winding shaft 63 extending upward from a bottom wall portion of the ribbon receiving portion 30. The ribbon winding shaft 63 and the winding spool 300 are rotatable integrally with each other. The second support bore 112 is supported by a rotary detection shaft 71 (described later). The rotary detection shaft 71 and the ribbon spool 81 are rotatable integrally with each other.

An ink ribbon 93 is wound over the ribbon spool 81 and the winding spool 300 such that a widthwise direction of the ink ribbon 93 is generally parallel to the vertical direction. The ink ribbon 93 spanning between the ribbon spool 81 and the winding spool 300 is partly exposed to an outside of the case 101 and positioned at the communication space 8 (see FIG. 9). The exposed part of the ink ribbon 93 will be referred to as a "specific ink ribbon 93A". The specific ink ribbon 93A faces the tubular member 9 located at the communication space 8 from a front side thereof.

2. Structure of Printing Mechanism 80

Figure 4:
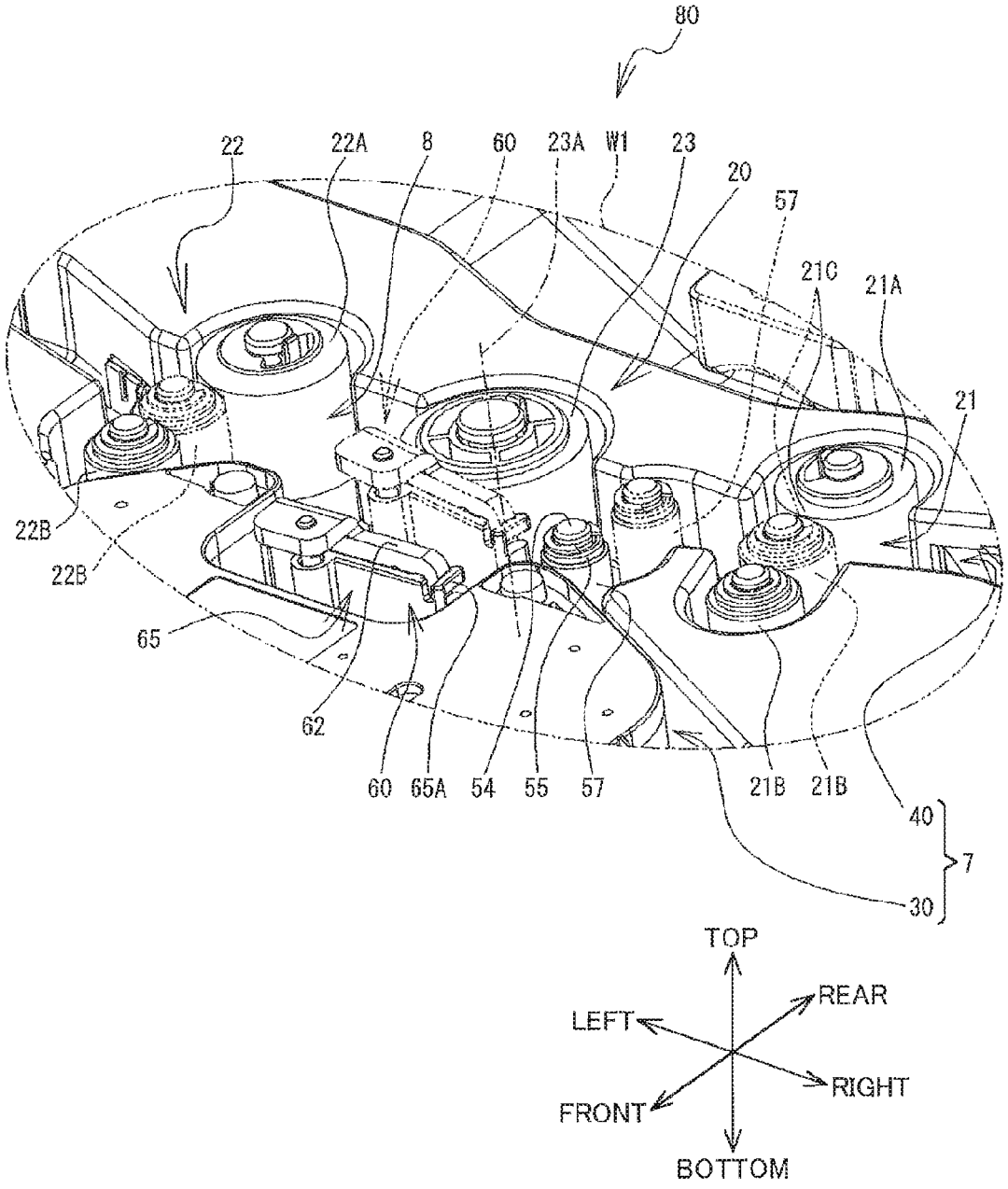
FIG. 4 is an enlarged perspective view of a printing mechanism 80 provided in the printer 1 according to the embodiment.

A printing mechanism 80 will be described with reference to FIGS. 3 through 6. A region encircled by a two-dotted chain line W1 in FIG. 4 is an enlarged view of a region encircled by a two-dotted chain line W1 in FIG. 2. The printing mechanism 80 is adapted to print one or more characters on the tubular member 9 overlapped with the specific ink ribbon 93A while nipping the tubular member 9 along with the specific ink ribbon 93A. A letter, a figure, a numeral, a symbol, and the like are examples of the character. The printing mechanism 80 includes a conveying amount detecting portion 70 (FIG. 3), a conveying portion 20 (FIG. 4), a printing portion 50 (FIG. 5), and a head moving portion 200 (FIG. 5).

2-1. Conveying Amount Detecting Portion 70

The conveying amount detecting portion 70 illustrated in FIG. 3 is adapted to detect a conveying amount of the ink ribbon 93 during a printing operation. The conveying amount detecting portion 70 includes the rotary detection shaft 71, a detection plate 72, and a sensor 73. The rotary detection shaft 71 is positioned further rightward than the ribbon winding shaft 63, and upstands from the bottom wall portion of the ribbon receiving portion 30. The rotary detection shaft 71 has an upper end portion assembled to the second support bore 112 of the ribbon cassette 90.

The detection plate 72 has a disc-like configuration protruding radially outwardly from a lower end portion of the rotary detection shaft 71. The detection plate 72 has a center coincident with an axis of the rotary detection shaft 71 in a plan view. The detection plate 72 is formed with a plurality of detection holes (not illustrated) surrounding the center of the detection plate 72. Specifically, the plurality of detection holes is arranged radially and spaced apart from each other at a regular interval in a circumferential direction of the detection plate 72. Each of the plurality of detection holes penetrates the detection plate 72 in the vertical direction.

The sensor 73 is a transmission type photo-sensor and includes a light emitting portion 73A and a light receiving portion 73B. The light emitting portion 73A and the light receiving portion 73B face each other in the vertical direction with the detection plate 72 interposed therebetween. The CPU (not illustrated) of the board 19 allows the light emitting portion 73A to emit light toward the light receiving portion 73B during the printing operation. The light emitted from the light emitting portion 73A and passing through one of the plurality of detection holes of the detection plate 72 is received by the light receiving portion 73B. At this time, the sensor 73 outputs an ON signal to the CPU. On the other hand, when the light emitted from the light emitting portion 73A is reflected at the detection plate 72, the light is not received by the light receiving portion 73B. In this case, the sensor 73 outputs an OFF signal to the CPU. Incidentally, a reflection type photo-sensor capable of detecting light reflected at the detection plate 72 may be available as the sensor 73.

2-2. Conveying Portion 20

As illustrated in FIG. 4, the conveying portion 20 includes a platen roller 23, a first conveying portion 21, a second conveying portion 22, and a drive motor (not illustrated). The platen roller 23 is positioned rearward of the communication space 8. The platen roller 23 is rotatable about a rotation axis 23A extending in the vertical direction. The platen roller 23 has an outer peripheral surface a part of which enters the tube receiving portion 40.

The first conveying portion 21 is positioned at an upstream side of the platen roller 23 in the tube conveying direction and is spaced apart therefrom. The first conveying portion 21 includes a drive roller 21A and a follower roller 21B. The drive roller 21A is positioned such that a part of its outer peripheral surface enters the tube receiving portion 40 from a rear side thereof. The follower roller 21B is rotatable and positioned forward of the drive roller 21A.

The second conveying portion 22 is positioned at a downstream side of the platen roller 23 in the tube conveying direction and is spaced apart therefrom. The second conveying portion 22 includes a drive roller 22A and a follower roller 22B. The drive roller 22A is positioned such that a part of its outer peripheral surface enters the tube receiving portion 40 from a rear side thereof. The follower roller 22B is rotatable and positioned forward of the drive roller 22A.

The follower roller 21B is movable between its retracted position and its advanced position. Similarly, the follower roller 22B is movable between its retracted position and its advance position. In FIG. 4, the follower roller 21B and the follower roller 22B those being at their respective retracted positions are indicated by solid lines, while the follower roller 21B and the follower roller 22B those being at their respective advanced positions are indicated by two-dotted chain lines. When the follower roller 21B is at its advanced position, the follower roller 21B enters the tube receiving portion 40 and approaches the drive roller 21A from a front side thereof. Similarly, when the follower roller 22B is at its advanced position, the follower roller 22B enters the tube receiving portion 40 and approaches the drive roller 22A from a front side thereof. At this time, the tubular member 9 is nipped between a portion of an outer peripheral surface of the follower roller 21B and a portion of the outer peripheral surface of the drive roller 21A those providing a closest gap between the outer peripheral surface of the follower roller 21B and the outer peripheral surface of the drive roller 21A (these two portions will be referred to as "prescribed portions 21C"). The two prescribed portions 21C nipping the tubular member 9 face each other with a minute gap therebetween. Similarly, the tubular member 9 is nipped between a portion of an outer peripheral surface of the follower roller 22B and a portion of the outer peripheral surface of the drive roller 22A those providing a closest gap between the outer peripheral surface of the follower roller 22B and the outer peripheral surface of the drive roller 22A. When the follower roller 21B is at its retracted position, the follower roller 21B is positioned forward of the tube receiving portion 40 and is spaced apart from the drive roller 21A. Similarly, when the follower roller 22B is at its retracted position, the follower roller 22B is positioned forward of the tube receiving portion 40 and is spaced apart from the drive roller 22A.

The follower roller 21B and the follower roller 22B are moved between the retracted positions and the advanced positions in accordance with a change in posture of a lever 79 (FIG. 2). The lever 79 is positioned in the interior of the body casing 11. Specifically, the lever 79 is positioned rearward of the tube receiving portion 40 and forward of the board 19. The lever 79 is movable between an open posture (indicated by solid lines in FIG. 2) and a closed posture (indicated by two-dotted chain lines in FIG. 2). At the open posture, the lever 79 extends upward from the body casing 11. At the closed posture, the lever 79 extends in the left-right direction in the interior of the body casing 11. When the user moves the lever 79 from its open posture to its closed posture, the follower roller 21B and the follower roller 22B are moved from the retracted positions to the advanced positions.

The drive motor (not illustrated) is disposed in the interior of the body casing 11. The drive motor is adapted to drive the platen roller 23, the drive roller 21A, the drive roller 22A, and the ribbon winding shaft 63 (FIG. 3). The drive motor is rotationally driven in accordance with a control by the CPU (not illustrated) of the board 19.

2-3. Printing Portion 50

As illustrated in FIG. 5, the printing portion 50 includes a support member 52 and a head 60. The support member 52 is positioned between the bottom wall portion of the receiving portion 7 (FIG. 2) and the support plate 14. The support member 52 is a plate-like member that is generally rectangular shaped in a plan view. The support member 52 has a right end portion pivotally movably supported by a pivot shaft 59 upstanding from the support plate 14.

In the following description, an axis of the pivot shaft 59 will be referred to as a "first axis 59A", a pivotal movement about the first axis 59A in a clockwise direction in a plan view will be referred to as a "first pivotally moving direction" as indicated by an arrow A1 in FIG. 5, and a pivotal movement about the first axis 59A in a counterclockwise direction in a plan view will be referred to as a "second pivotally moving direction" as indicated by an arrow A2 in FIG. 5. That is, the second pivotally moving direction is a direction opposite to the first pivotally moving direction. The first axis 59A is in parallel to the rotation axis 23A of the platen roller 23.

The support member 52 has a generally center portion in its longitudinal direction provided with a shaft member 54 protruding upward therefrom. The shaft member 54 is in parallel to the rotation axis 23A of the platen roller 23. The shaft member 54 has an upper portion extending through the communication hole (not illustrated) formed in the bottom wall portion of the receiving portion 7 and entering the communication space 8 (FIG. 4). A rotary member 55 is rotatably provided at an upper end portion of the shaft member 54. The rotary member 55 is a roller. The rotary member 55 is positioned above and spaced apart from the support plate 14. A covering portion 57 is provided at the rotary member 55. The covering portion 57 is formed over an outer circumferential surface of the rotary member 55 continuously in a circumferential direction of the rotary member 55.

The support member 52 has a connecting wall portion 53. The connecting wall portion 53 is provided at a downstream end portion of the support member 52 in the first pivotally moving direction (the direction A1). The connecting wall portion 53 is positioned farther away from the first axis 59A than the covering portion 57 from the first axis 59A. The connecting wall portion 53 is formed with a connection hole 53A. The connection hole 53A is a cylindrical bore penetrating the connecting wall portion 53 in the vertical direction.

The head 60 is supported at a left portion of the support member 52. The head 60 is pivotally movable about the first axis 59A along with the support member 52. The head 60 includes a heatsink 62, a heater 69, and a cover member 65.

Figure 9:
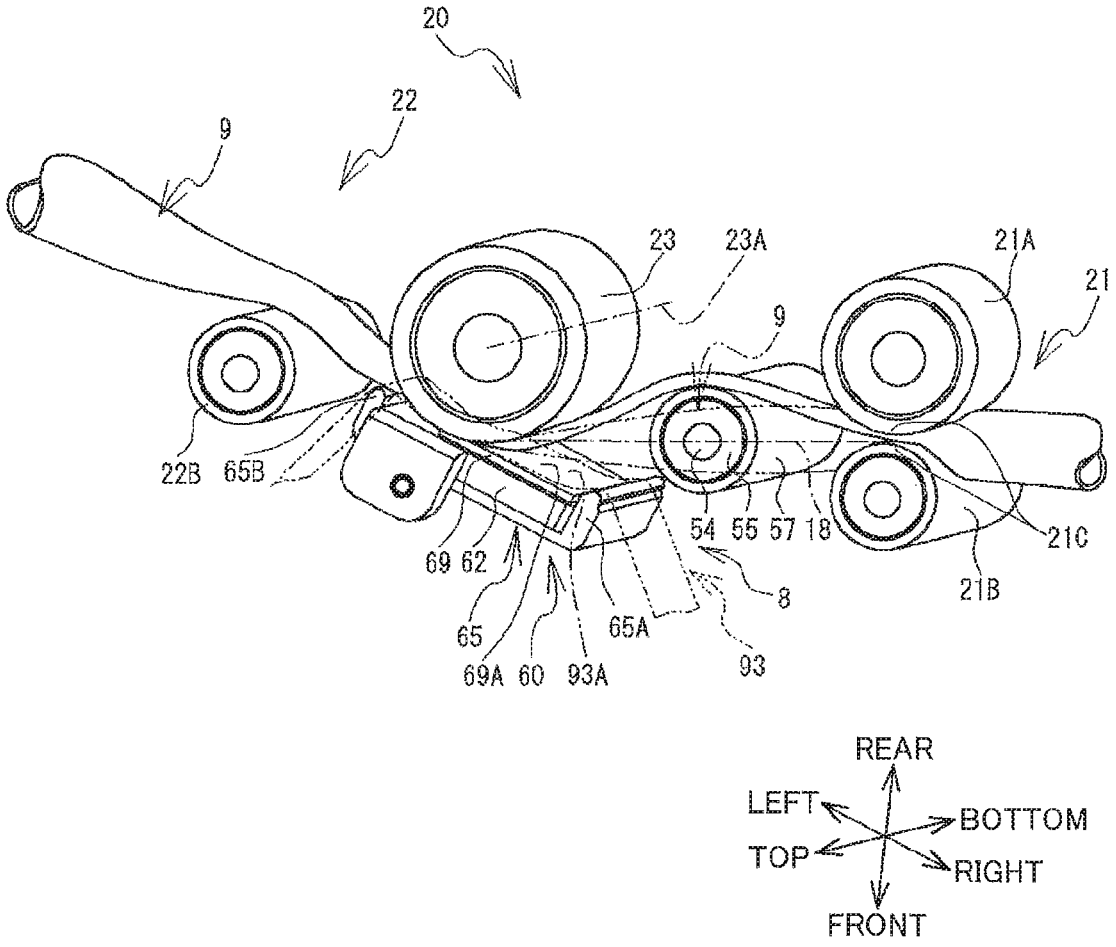
FIG. 9 is a perspective view of a conveying portion 20 provided in the printer 1 according to the embodiment.

The heatsink 62 is a plate-like member made from metal. The heatsink 62 extends from the support member 52 to a position above the communication hole (not illustrated) formed in the bottom wall portion of the receiving portion 7. The heatsink 62 has a thickness in the first pivotally moving direction (the direction A1), and is rectangular shaped extending generally in parallel to the longitudinal direction of the support member 52. The heatsink 62 has an upper end portion positioned forward of the specific ink ribbon 93A positioned in the communication space 8 (FIG. 9). In other words, the upper end portion of the heatsink 62 is positioned downstream of the specific ink ribbon 93A in the second pivotally moving direction (the direction A2).

The heater 69 is a plate-like member attached to an upper portion of a downstream end surface of the heatsink 62 in the first pivotally moving direction (the direction A1). The heater 69 is adapted to generate heat in accordance with a control by the CPU (not illustrated) of the board 19. The heater 69 has a downstream end surface in the first pivotally moving direction (the direction A1) that functions as a printing surface 69A. The printing surface 69A is adapted to nip the specific ink ribbon 93A and the tubular member 9 in cooperation with the platen roller 23, with the tubular member 9 overlapped with the specific ink ribbon 93A.

The cover member 65 is made from resin. The cover member 65 covers a right end surface, a left end surface, and a downstream end surface in the second pivotally moving direction (the direction A2) of the heatsink 62. Since the heatsink 62 is covered with the cover member 65, strength against a force directing forward can be improved. The cover member 65 includes a right guide portion 65A and a left guide portion 65B. The right guide portion 65A and the left guide portion 65B cover the right end surface of the heatsink 62 and the left end surface of the heatsink 62, respectively. The right guide portion 65A has a downstream end portion in the first pivotally moving direction (the direction A1), and the downstream end portion of the right guide portion 65A is arcuately curved while protruding in the first pivotally moving direction (the direction A1). Similarly, the left guide portion 65B has a downstream end portion in the first pivotally moving direction (the direction A1), and the downstream end portion of the left guide portion 65B is arcuately curved while protruding in the first pivotally moving direction (the direction A1). The downstream end portion of the right guide portion 65A faces the downstream end portion of the left guide portion 65B in a longitudinal direction of the heatsink 62 such that the heater 69 is positioned between the downstream end portion of the right guide portion 65A and the downstream end portion of the left guide portion 65B. The specific ink ribbon 93A positioned in the communication space 8 spans between the downstream end portion of the right guide portion 65A and the downstream end portion of the left guide portion 65B, as illustrated in FIG. 9.

The downstream end portion of the right guide portion 65A is positioned downstream of the printing surface 69A of the heater 69 in the first pivotally moving direction (the direction A1). Further, the downstream end portion of the left guide portion 65B is positioned downstream of the downstream end surface of the heatsink 62 in the first pivotally moving direction (the direction A1) and is also positioned downstream of the printing surface 69A in the second pivotally moving direction (the direction A2).

Figure 12:
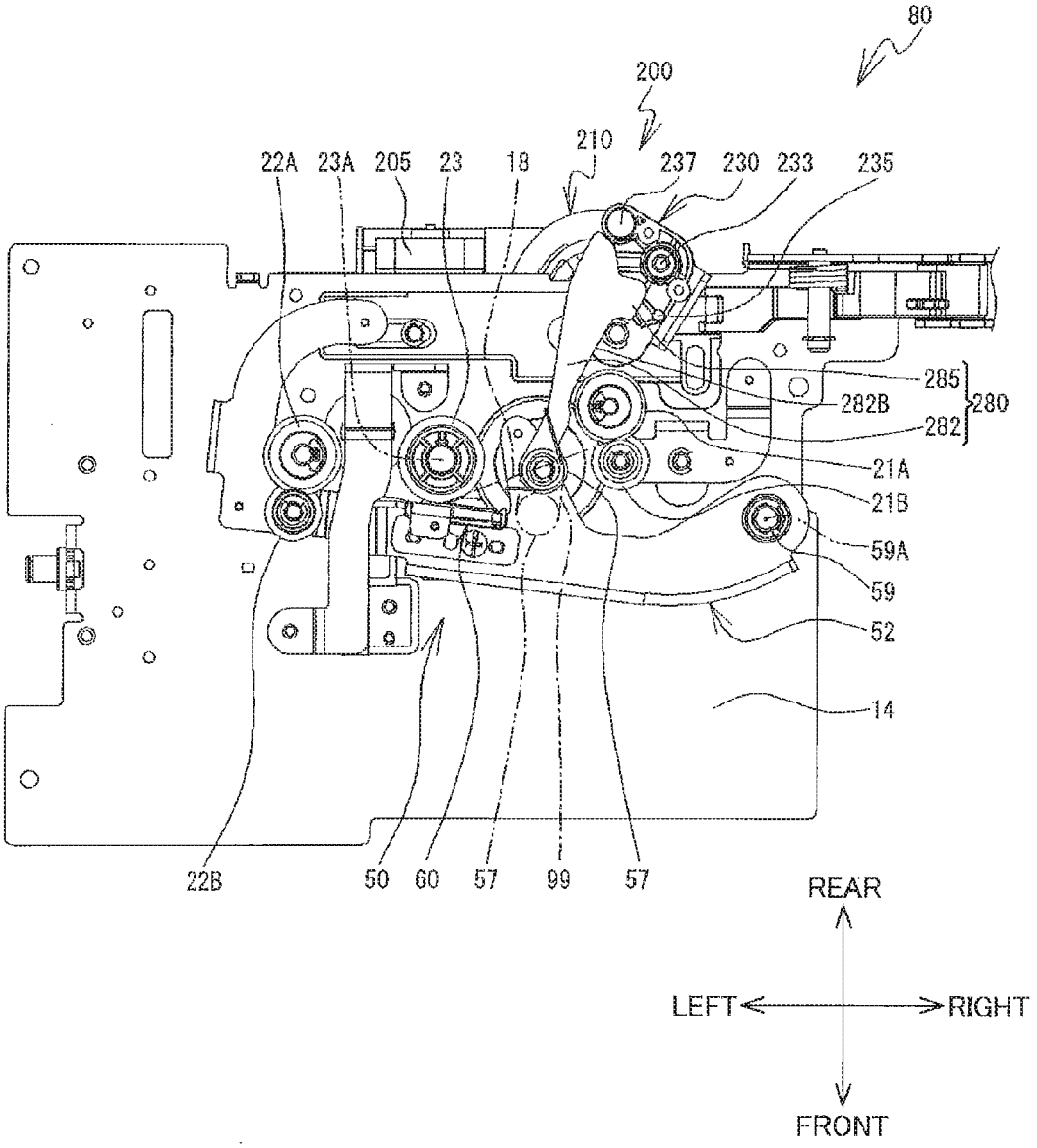
FIG. 12 is a plan view of the printing mechanism 80 in which the support member 52 is at the nipping position.

The head 60 is pivotally movable about the first axis 59A along with the support member 52 between a head-separated position (FIGS. 4 and 5) and a head-nipping position (FIGS. 4 and 12). When the head 60 is at the head-nipping position, the specific ink ribbon 93A and the tubular member 9 overlapped therewith are nipped between the heater 69 and the platen roller 23. When the head 60 is at the head-separated position, the heater 69 is positioned away from and rearward relative to the specific ink ribbon 93A positioned in the communication space 8. In other words, the head 60 is positioned farther from the platen roller 23 at the head-separated position than at the head-nipping position. In FIG. 4, the head 60 at the head-separated position is indicated by solid lines, while the head 60 at the head-nipping position is indicated by two-dotted chain lines.

In the following description, a line connecting a portion closest to the platen roller 23 of the printing surface 69A of the head 60 at the head-nipping position and the two prescribed portions 21C (FIG. 4) will be referred to as an "imaginary straight line 18" (FIG. 9). The imaginary straight line 18 is positioned forward of the rotation axis 23A of the platen roller 23. Further, a position of the support member 52 for positioning the head 60 at the head-nipping position will be referred to as a "nipping position" (FIG. 12), and a position of the support member 52 for positioning the head 60 at the head-separated position will be referred to as a "separated position" (FIG. 5). The nipping position is a position displaced from the separated position in the first pivotally moving direction (the direction A1). When the support member 52 is at the separated position, the covering portion 57 (indicated by a two-dotted chain line in FIG. 12) is positioned away from and forward of the imaginary straight line 18. When the support member 52 is at the nipping position, a rear portion of the covering portion 57 is positioned rearward of the imaginary straight line 18 (FIG. 12).

A region in which the covering portion 57 is moved in conjunction with the pivotal movement of the support member 52 between the nipping position and the separated position will be referred to as a "movement path 99" (FIG. 12). The covering portion 57 is moved along the movement path 99 in conjunction with the pivotal movement of the support member 52. The movement path 99 intersects the imaginary straight line 18 in a plan view.

2-4. Head Moving Portion 200

A head moving portion 200 will be described with reference to FIGS. 5 and 6. The head moving portion 200 is a mechanism for moving the support member 52 between the nipping position and the separated position. The head moving portion 200 includes a motor 205, a cam member 210, a protruding portion 229, a moving member 230, and a connecting member 280. The head moving portion 200 transmits a rotational driving force of the motor 205 to the support member 52 by way of the cam member 210 and the moving member 230.

The motor 205 is configured to generate a rotational driving force. The motor 205 is fixed to a rear portion of a lower surface of the support plate 14 at a generally center portion thereof in the left-right direction. The motor 205 is rotated in a forward direction and a reverse direction in accordance with a control by the CPU (not illustrated) of the board 19. The cam member 210 is positioned rightward of the motor 205 and at the rear portion of the lower surface of the support plate 14. The cam member 210 has a plate-like shape that is generally circular in a plan view. In other words, the cam member 210 is disc-like shaped having a thickness in the vertical direction. The cam member 210 is rotatable about an axis extending in the vertical direction (hereinafter referred to as a "second axis 210A"). The second axis 210A extends in the vertical direction through a right rear portion of the support plate 14. The cam member 210 has a rear portion positioned rearward of a rear end of the support plate 14 in a plan view. The cam member 210 rotates in a clockwise direction in a plan view in conjunction with the rotation of the motor 205 in the forward direction, while rotating in a counterclockwise direction in a plan view in conjunction with the rotation of the motor 205 in the reverse direction.

Figure 6:
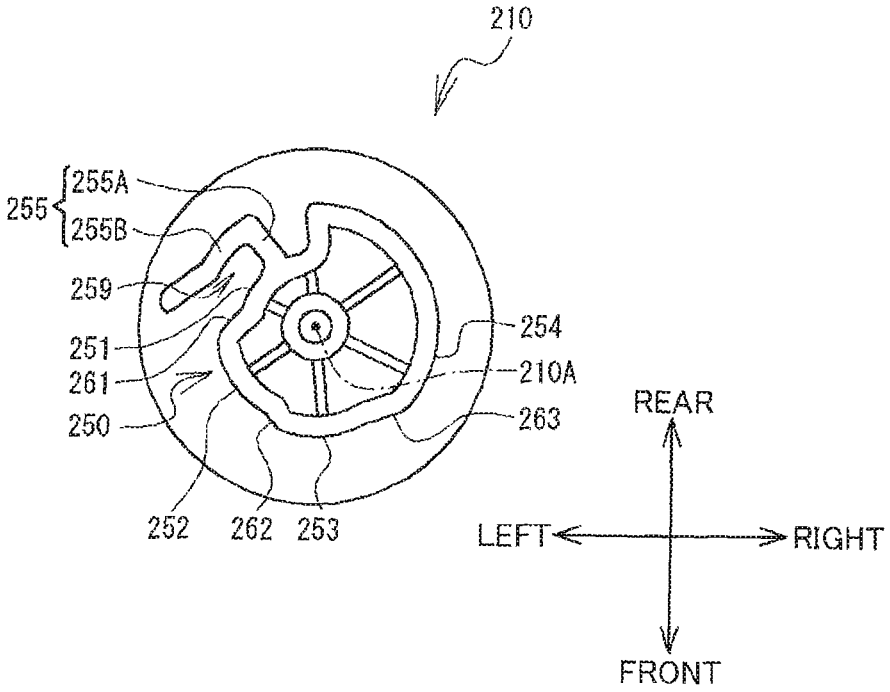
FIG. 6 is a plan view of a cam member 210 provided in the printer 1 according to the embodiment.

As illustrated in FIG. 6, the cam member 210 has a sliding surface 250. The sliding surface 250 is a surface arranged in a rotational direction of the cam member 210 whose rotational center is the second axis 210A. The sliding surface 250 includes an extension surface 251, a specific surface 261, an extension surface 252, a specific surface 262, an extension surface 253, a specific surface 263, and an extension surface 254 arranged in this order in a counterclockwise direction in a plan view. The extension surfaces 251 through 254 extend in parallel to the rotational direction of the cam member 210. Further, the extension surfaces 251 through 254 are arranged such that distances in a radial direction of the cam member 210 from the second axis 210A to the respective extension surfaces 251 through 254 are gradually increased in the order from the extension surface 251 to the extension surface 254. That is, a distance between the second axis 210A and the extension surface 251 is the shortest distance, and a distance between the second axis 210A and the extension surface 254 is the longest distance.

The specific surface 261 connects neighboring ends of the extension surface 251 and the extension surface 252. The specific surface 262 connects neighboring ends of the extension surface 252 and the extension surface 253. The specific surface 263 connects neighboring ends of the extension surface 253 and the extension surface 254. That is, the specific surfaces 261 through 263 extend in a direction away from the second axis 210A toward downstream sides thereof in the counterclockwise direction in a plan view.

A wall portion 255 is provided at a downstream end portion of the extension surface 251 in a clockwise direction in a plan view. The wall portion 255 includes a first wall portion 255A and a second wall portion 255B. The first wall portion 255A extends outwardly from the extension surface 251 in the radial direction of the cam member 210. The second wall portion 255B extends from a radially outer end portion of the first wall portion 255A in a counterclockwise direction in a plan view about the second axis 210A. The second wall portion 255B faces the extension surface 251 with a gap 259 interposed therebetween.

FIG. 6 illustrates an initial rotational position of the cam member 210. When the cam member 210 is at the initial rotational position, the first wall portion 255A is angularly displaced by 45 degrees in the counterclockwise direction in a plan view about the second axis 210A from a position immediately rearward of the second axis 210A. The sliding surface 250 passes through a position rearward of the rear end of the support plate 14 (FIG. 5) in accordance with a clockwise rotation of the cam member 210 in a plan view starting from the initial rotational position. More specifically, the extension surface 251, the specific surface 261, the extension surface 252, the specific surface 262, the extension surface 253, the specific surface 263, and the extension surface 254 successively pass through the position rearward of the rear end of the support plate 14 in this order.

As illustrated in FIG. 5, the protruding portion 229 is a shaft-like member extending upward from a rear end portion of the support plate 14. The protruding portion 229 is positioned rightward and forward of the second axis 210A in a plan view. The protruding portion 229 has an upper end portion positioned below the bottom wall portion of the receiving portion 7 (FIG. 4). In the following description, a rotation about the protruding portion 229 in a clockwise direction in a plan view will be referred to as a "first prescribed direction" as indicated by an arrow B1 in FIG. 5, and a rotation about the protruding portion 229 in a counterclockwise direction in a plan view will be referred to as a "second prescribed direction" as indicated by an arrow B2 in FIG. 5. That is, the second prescribed direction is a direction opposite to the first prescribed direction.

The moving member 230 is a plate-like member that is generally rectangular shaped and has a thickness in the vertical direction. The moving member 230 is pivotally movably supported by the protruding portion 229. The moving member 230 includes a base portion 231, a slide pin 232 (FIGS. 8A through 8D), a projecting portion 233, a boss 235, and a connecting portion 237. The base portion 231 is a plate-like member having a generally rectangular shape in a plan view. The base portion 231 has one end portion in its longitudinal direction facing the support plate 14 from above. The one end portion of the base portion 231 is pivotally movably supported by the protruding portion 229.

Figure 8A:
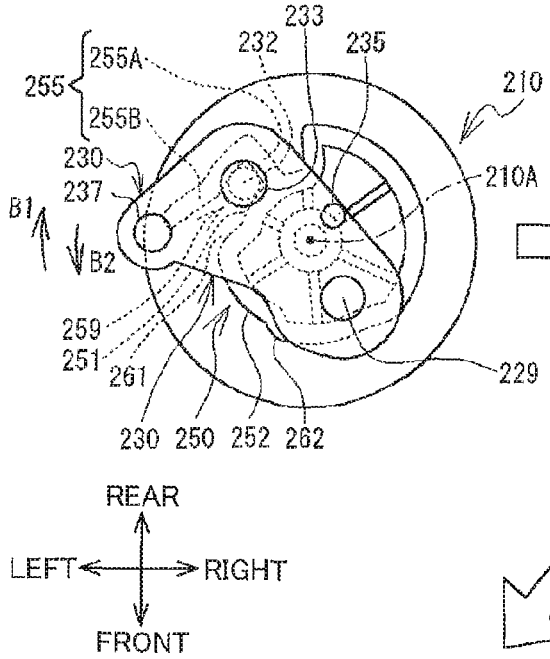
FIGS. 8A through 8D are views illustrating a positional relationship between the moving member 230 and a cam member 210 when the cam member 210 is rotated from an initial rotational position to a first rotational position.

The base portion 231 has a downstream end portion in the first prescribed direction (the direction B1), and the slide pin 232 (FIGS. 8A through 8D) protrudes downward from the downstream end portion of the base portion 231 at a position rearward of the support plate 14. The slide pin 232 is positioned substantially opposite to the protruding portion 229 with respect to the second axis 210A of the cam member 210 in a plan view. That is, the slide pin 232 is provided at a position separated from the protruding portion 229. The slide pin 232 is positioned radially outward of the sliding surface 250 of the cam member 210, and is in contact with the sliding surface 250 of the cam member 210. The slide pin 232 can be positioned in the gap 259 of the cam member 210 (FIG. 8A).

The projecting portion 233 has a columnar configuration and protrudes upward from the base portion 231. The projecting portion 233 is coaxial with the slide pin 232. The base portion 231 has a portion downstream of the second axis 210A of the cam member 210 in the first prescribed direction (the direction B1), and the boss 235 protrudes upward from the downstream portion of the base portion 231.

The base portion 231 has a downstream end portion in the second prescribed direction (the direction B2), and the connecting portion 237 has a columnar configuration protruding upward from the downstream end portion of the base portion 231. A resilient member 201 is attached to the connecting portion 237. The resilient member 201 is a tension spring resiliently deformable generally in the front-rear direction. The resilient member 201 has a rear end portion attached to the connecting portion 237 and a front end portion attached to the connection hole 53A of the support member 52. Accordingly, the connecting portion 237 is connected to the support member 52 through the resilient member 201. In the following description, a minimum distance between a center of the connecting portion 237 and a center of the connection hole 53A in a plan view will be referred to as a "prescribed distance". In FIG. 5, the prescribed distance is designated by a dimension L.

The moving member 230 is pivotally movable about the protruding portion 229. The moving member 230 illustrated in FIG. 5 is positioned at a first pressure release position. When the moving member 230 is at the first pressure release position, the slide pin 232 is positioned in the gap 259 of the cam member 210 at the initial rotational position. More specifically, when the moving member 230 is at the first pressure release position, the slide pin 232 is in contact with the first wall portion 255A while positioned downstream of the first wall portion 255A in the counterclockwise direction in a plan view about the second axis 210A (FIG. 8A).

The connecting member 280 is a plate-like member having a thickness in the vertical direction. The connecting member 280 connects the protruding portion 229 to the support member 52. The connecting member 280 is positioned higher than (upward of) the moving member 230. The connecting member 280 includes a base portion 282 and an opposing portion 285.

The base portion 282 has a rectangular shape elongated generally in the front-rear direction. The base portion 282 has a front end portion positioned below the rotary member 55 and pivotally movably supported to the shaft member 54 of the support member 52. The base portion 282 has a rear end portion positioned rearward of the boss 235. A rear portion of the base portion 282 faces a portion of the base portion 231 of the moving member 230 from above, the portion of the base portion 231 being an area between the protruding portion 229 and the connecting portion 237. In other words, a portion of the base portion 282 of the connecting member 280 and a portion of the base portion 231 of the moving member 230 face each other in the vertical direction.

The opposing portion 285 is a wall portion protruding from a right end of the base portion 282 at its rear portion in a clockwise direction in a plan view about the shaft member 54. The opposing portion 285 has a generally rectangular shape in a plan view. The right end of the base portion 282 has a portion positioned forward of the opposing portion 285, and in the following description, this portion will be referred to as a "specific portion 282B". The specific portion 282B extends linearly in a plan view.

A torsion spring 209 (FIG. 5) is provided at the shaft member 54. A lower portion of the base portion 282 is urged in a clockwise direction in a plan view about the shaft member 54 by the torsion spring 209. However, pivotal movement of the connecting member 280 in the clockwise direction is restricted upon abutment of the connecting member 280 with one of the projecting portion 233 and the protruding portion 229. Thus, the connecting member 280 allows the support member 52 to be connected to the moving member 230.

FIG. 5 illustrates the connecting member 280 at its second pressure release position. The second pressure release position is a foremost position of the connecting member 280 within a movable range thereof. When the connecting member 280 is at the second pressure release position, the connecting member 280 allows the support member 52 at its separated position to be connected to the moving member 230 at its first pressure release position.

Operations of the connecting member 280 with the above configuration will be described. The support member 52 connected to the moving member 230 through the resilient member 201 is pivotally moved in the first pivotally moving direction (the direction A1) in conjunction with the pivotal movement of the moving member 230 in the first prescribed direction (the direction B1). The connecting member 280 pivotally movably supported by the shaft member 54 is displaced generally in the front-rear direction in conjunction with the pivotal movement of the support member 52.

In the following direction, a direction in which the connecting member 280 at the second pressure release position is displaced in conjunction with the pivotal movement of the moving member 230 in the first prescribed direction (the direction B) will be referred to as a "specific direction". The specific direction is indicated by an arrow C in FIGS. 7A and 7B. The specific direction is a direction crossing both the vertical direction and the left-right direction. Incidentally, when the connecting member 280 is at the second pressure release position, a rear end portion of the base portion 282 is in contact with the projecting portion 233 of the moving member 230 from an upstream side thereof in the specific direction.

3. Operations of Printer 1

Operations performed in the printer 1 will be described with reference to FIGS. 4 through 12. In the drawings, the drive roller 22A is omitted in FIG. 9, and the resilient member 201 is omitted in FIGS. 7A through 7D, 10A through 10C, and 12. The printer 1 is at its initial state (FIGS. 2, 4 and 5) prior to starting its operations. When the printer 1 is at the initial state, the cam member 210 is at the initial rotational position, the moving member 230 is at the first pressure release position, the connecting member 280 is at the second pressure release position, the support member 52 is at the separated position, and the head 60 is at the head-separated position.

In a state where the printer 1 is at the initial state, a user opens the cover 12 relative to the body casing 11, and moves the lever 79 from the closed posture to the open posture. Then, the user moves the lever 79 from the open posture to the closed posture after the user attaches the ribbon cassette 90 to the ribbon receiving portion 30 and installs the tubular member 9 to the tube receiving portion 40. The follower roller 21B and the follower roller 22B are displaced from the retracted positions to the advanced positions, respectively, so that the tubular member 9 is nipped at positions between the drive roller 21A and the follower roller 21B and between the drive roller 22A and the follower roller 22B. Hence, the tubular member 9 is fixed in position in a depthwise direction of the tube receiving portion 40 and a widthwise direction of the tube receiving portion 40. The depthwise direction is the vertical direction. In other words, the depthwise direction is a direction perpendicular to the tube conveying direction. The widthwise direction is a direction perpendicular to the tube conveying direction and the depthwise direction of the tube receiving portion 40.

When the follower roller 21B and the follower roller 22B are displaced from the retracted positions to the advanced positions, respectively, a portion of the tubular member 9 located between the platen roller 23 and the two prescribed portions 21C provides a linear posture extending along the imaginary straight line 18. In FIG. 9, the portion of the tubular member 9 extending linearly along the imaginary straight line 18 is illustrated by two-dotted chain lines.

After the user closes the cover 12 relative to the body casing 11, the printer 1 will perform a tube nipping operation, a force adjustment operation, a printing operation, and a tube releasing operation. In the tube nipping operation, the printer 1 moves the head 60 from the head-separated position to the head-nipping position. In the force adjustment operation, the printer 1 adjusts a nipping force. The nipping force is a force applied to the specific ink ribbon 93A and the tubular member 9 when the heater 69 of the head 60 at the head-separated position nips the specific ink ribbon 93A and the tubular member 9 in cooperation with the platen roller 23. In the printing operation, the printer 1 prints one or more characters on the tubular member 9. In the tube releasing operation, the printer 1 moves the head 60 from the head-nipping position to the head-separated position. These four operations will next be described in this order.

3-1. Tube Nipping Operation

The tube nipping operation will next be described with reference to FIGS. 5 and 7A through 9. In response to input of a command, by the user, to the operating portion 17 for starting the tube nipping operation, the printer 1 at the initial state starts the tube nipping operation. Incidentally, phases represented by FIGS. 7A, 7B, 7C, and 7D correspond to phases represented by FIGS. 8A, 8B, 8C, and 8D, respectively. Further, the state of the moving member 230 illustrated in FIGS. 7A and 8A corresponds to the state of the moving member 230 illustrated in FIG. 5. Further, the tubular member 9 and the slide pin 232 are omitted in FIG. 7A through 7D, and the heater 69 of the head 60 is conceptually illustrated in FIGS. 7A through 7D. The same applies to FIGS. 10A through 10C.

Figure 7A:
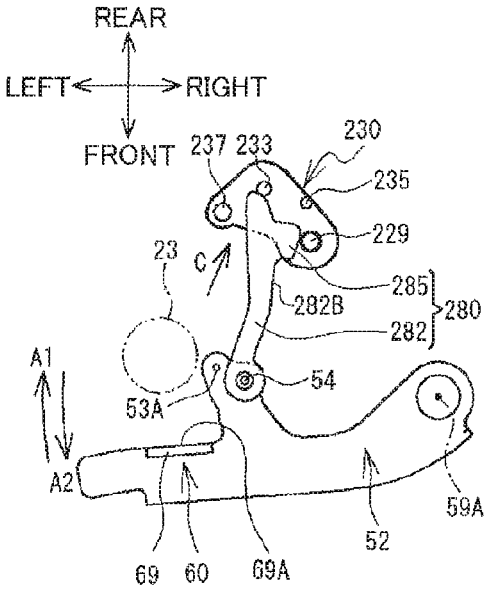
FIGS. 7A through 7D are views illustrating a positional relationship among the support member 52, a moving member 230 and a connecting member 280 when the support member 52 is moved from the separated position to a nipping position.
Figure 7B:
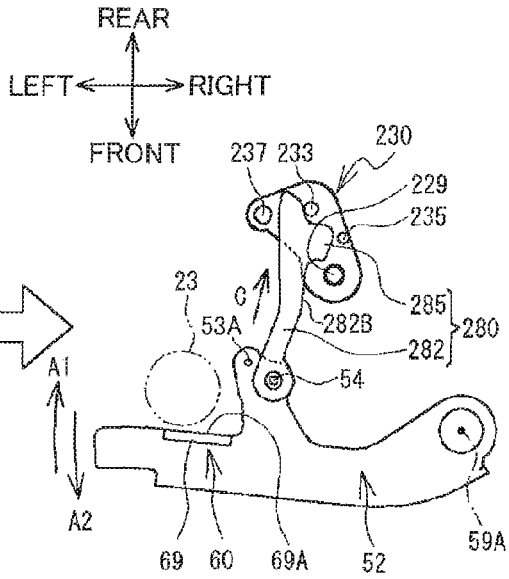

As illustrated in FIGS. 7A through 8D, the cam member 210 rotates in the clockwise direction in a plan view from the initial rotational position in conjunction with the forward rotation of the motor 205 by the control of the CPU (not illustrated) of the board 19 (FIGS. 7A, 7B). By the clockwise rotation of the cam member 210, the extension surface 251 is slidingly moved relative to the slide pin 232, so that the moving member 230 is pivotally moved in the first prescribed direction (the direction B1) from the first pressure release position (FIGS. 8A and 8B). By the pivotal movement of the moving member 230 in the first prescribed direction, the support member 52 is pivotally moved in the first pivotally moving direction (the direction A1) from the separated position through the resilient member 201 (FIGS. 7A and 7B). The covering portion 57 is also pivotally moved in the first pivotally moving direction (the direction A1) along with the support member 52, so that the covering portion 57 is brought into contact with a portion of the tubular member 9 from a front side thereof, the portion extending along the imaginary straight line 18.

The connecting member 280 is displaced in the specific direction (the direction C) from the second pressure release position in conjunction with the pivotal movement of the support member 52 in the first pivotally moving direction (the direction A1) (FIGS. 7A and 7B). In this case, the connecting member 280 is displaced in the specific direction while a contact of the rear end portion of the base portion 282 of the connecting member 280 with the projecting portion 233 from a downstream side thereof in the second prescribed direction (the direction B2) is maintained. That is, the connecting member 280 urged by the torsion spring 209 is displaced in the specific direction while gradually angularly moved in the clockwise direction in a plan view about the shaft member 54 in conjunction with the pivotal movement of the moving member 230 in the first prescribed direction (the direction B1). In this case, the opposing portion 285 is gradually displaced rearward relative to the protruding portion 229.

Figure 7C:
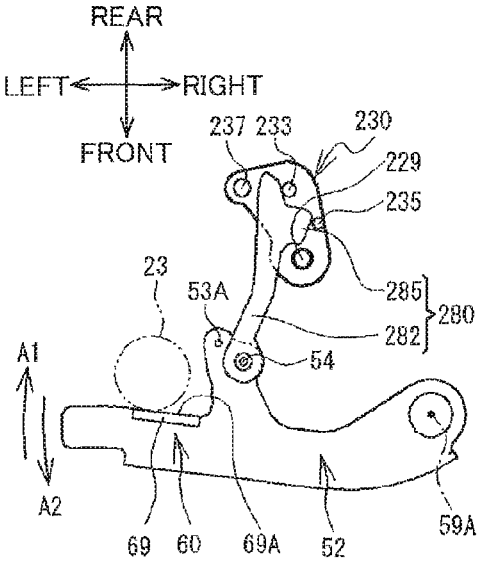
Figure 8B:
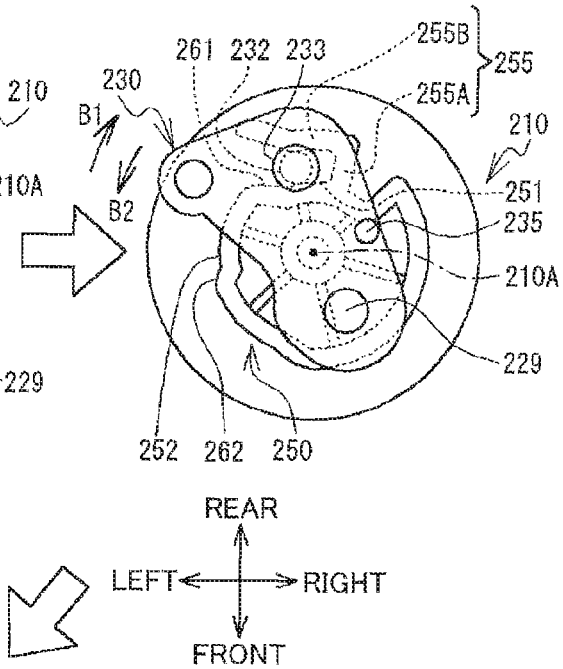
Figure 8C:
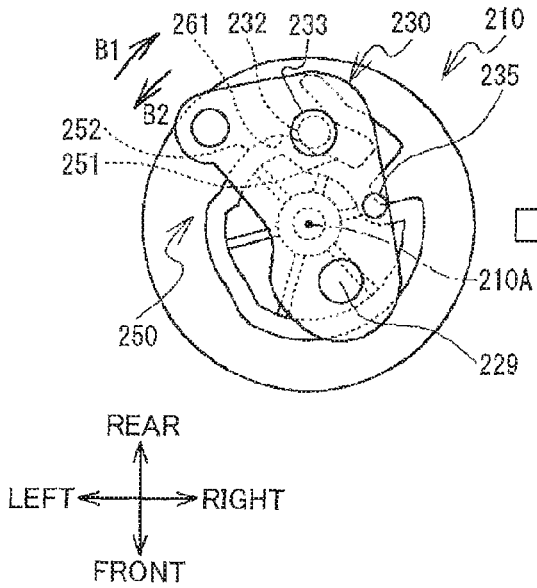

The moving member 230 is pivotally moved to an intermediate position when the specific surface 261 is brought into contact with the slide pin 232 in conjunction with the rotation of the cam member 210 (FIGS. 7C and 8C). When the moving member 230 is at the intermediate position, the slide pin 232 is at a position slightly displaced in the first prescribed direction (the direction B1). The support member 52 is moved to the nipping position and the head 60 is moved to the head-nipping position as a result of the pivotal movement of the moving member 230 to the intermediate position (FIG. 7C). The printing surface 69A of the heater 69 nips the tubular member 9 and the specific ink ribbon 93A in cooperation with the platen roller 23 (FIG. 9). The connecting member 280 is displaced to a rearmost position as a result of the pivotal movement of the support member 52 to the nipping position (FIG. 7C). The rearmost position is a rearmost position of the connecting member 280 within the movable range thereof. When the connecting member 280 is at the rearmost position, the rear end portion of the base portion 282 is positioned at a downstream side of the projecting portion 233 in the second prescribed direction (the direction B2) and in contact with the projecting portion 233, and the right end portion of the opposing portion 285 is positioned at a downstream side of the boss 235 in the second prescribed direction (the direction B2) and in contact with the boss 235.

As illustrated in FIG. 9, the rear portion of the covering portion 57 is moved to a position further rearward than the imaginary straight line 18 as a result of the pivotal movement of the support member 52 to the nipping position. In this case, the covering portion 57 approaches the platen roller 23 so that the portion of the tubular member 9 extending along the imaginary straight line 18 approaches the platen roller 23. As a result, the portion of the tubular member 9 extending along the imaginary straight line 18 is bent rearward such that each end of the portion of the tubular member 9 in the extending direction functions as a fulcrum. Thus, a contacting area of the tubular member 9 relative to the platen roller 23 is increased in comparison with a case where the support member 52 is at the separated position.

Figure 7D:
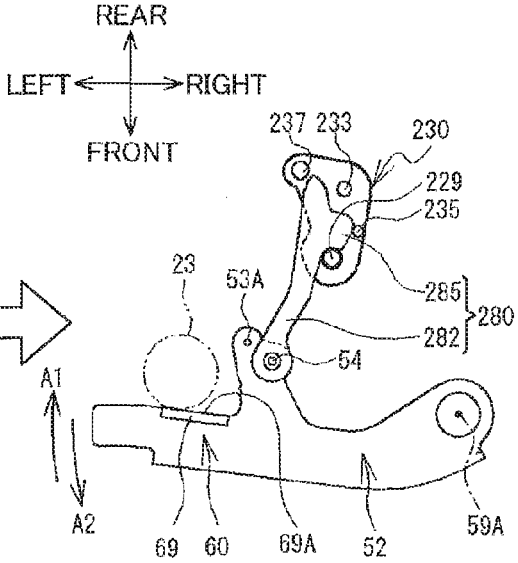

The motor 205 (FIG. 5) continuously rotates in the forward direction, so that the cam member 210 further rotates in the clockwise direction in a plan view (FIGS. 8C and 8D), and the moving member 230 is further pivotally moved in the first prescribed direction (the direction B1) from the intermediate position. In this case, the projecting portion 233 is separated from the connecting member 280 in the first prescribed direction (the direction B1) while the contact between the boss 235 and the connecting member 280 is maintained. Because the platen roller 23 restricts the heater 69 from moving in the first pivotally moving direction (the direction A1), the support member 52 at the nipping position is restricted from moving in the first pivotally moving direction (the direction A1) in spite of the pivotal movement of the moving member 230 in the first prescribed direction (the direction B1) as illustrated in FIGS. 7C and 7D. Accordingly, at this time, the shaft member 54 is stationary and maintained at its position. In conjunction with the pivotal movement of the moving member 230 in the first prescribed direction (the direction B1), contacting state between the opposing portion 285 of the connecting member 280 urged by the torsion spring 209 and the boss 235 is maintained. Therefore, the connecting member 280 is displaced in a clockwise direction in a plan view about the shaft member 54 from the rearmost position (FIGS. 7C and 7D).

Figure 8D:
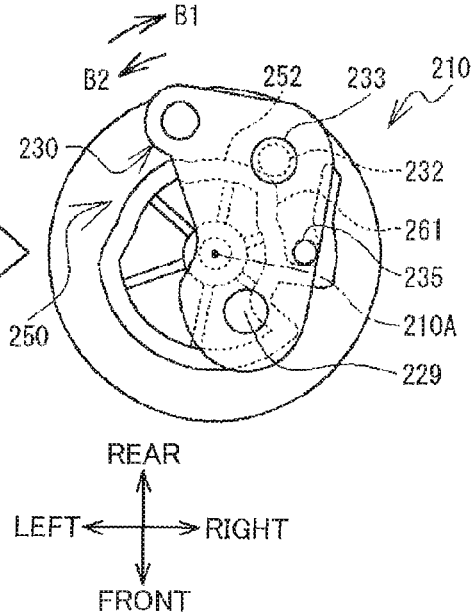

The cam member 210 rotates to a first rotational position (FIG. 8D). The first rotational position is a rotational position of the cam member 210 where the first wall portion 255A is generally positioned rightward of the second axis 210A. The first rotational position is positioned displaced in a clockwise direction in a plan view from the initial rotational position.

The moving member 230 is pivotally moved to a first operating position (FIG. 7D) as a result of the rotation of the cam member 210 to the first rotational position. When the moving member 230 is at the first operating position, the slide pin 232 is positioned slightly displaced in the first prescribed direction (the direction B1) from a position rearward of the protruding portion 229. At this time, the slide pin 232 is in contact with a downstream end portion in a clockwise direction in a plan view of the extension surface 252 of the cam member 210 at the first rotational position (FIG. 8D). The connecting member 280 is displaced to a second operating position (FIG. 7D) as a result of the pivotal movement of the moving member 230 to the first operating position. The second operating position is a position of the connecting member 280 slightly displaced in the clockwise direction in a plan view about the shaft member 54 from the rearmost position. The connecting member 280 at the second operating position connects the moving member 230 at the first operating position and the support member 52 at the nipping position. When the connecting member 280 is displaced to the second operating position, the opposing portion 285 faces the protruding portion 229 at a position downstream of the protruding portion 229 in the specific direction (the direction C), the specific portion 282B is in contact with the protruding portion 229 from a left side thereof, and the right end portion of the opposing portion 285 is positioned at a downstream side of the boss 235 in the second prescribed direction (B2) and in contact with the boss 235.

The prescribed distance (the dimension L) is increased by pivotally moving the moving member 230 from the intermediate position to the first operating position. Therefore, an amount of the resilient deformation of the resilient member 201 is increased. Thus, the heater 69 urges the specific ink ribbon 93A and the tubular member 9 toward the platen roller 23, and the covering portion 57 urges the bending portion of the tubular member 9 in the first pivotally moving direction (the direction A1). In this case, the support member 52 receives a reaction force directing in the second pivotally moving direction (the direction A2). However, because the opposing portion 285 faces the protruding portion 229 at a position downstream of the protruding portion 229 in the specific direction (the direction C), the protruding portion 229 restricts the connecting member 280 at the second operating position from moving forward. Consequently, the pivotal movement of the support member 52 in the second pivotally moving direction (the direction A2) is restricted. Hence, the heater 69 and the covering portion 57 are restricted from moving in the second pivotally moving direction (the direction A2).

The heatsink 62 receives a reaction force directing in the forward direction while the heater 69 urges the specific ink ribbon 93A and the tubular member 9. Even in this case, the heatsink 62 may not be inclined forward because the cover member 65 increases the strength of the heatsink 62 against the force directing forward.

Upon rotation of the cam member 210 to the first rotational position (FIG. 8D), the CPU (not illustrated) of the board 19 stops the rotation of the motor 205. Thus, the printer 1 terminates the tube nipping operation.

Positional relationship of the boss 235 and the projecting portion 233 relative to the connecting member 280 when the moving member 230 is at the first operating position will be described with reference to FIG. 7D. The boss 235 faces the right end portion of the opposing portion 285 of the connecting member 280 at the second operating position at a position downstream thereof in the first prescribed direction (the direction B1) and is in contact with the same. On the other hand, the projecting portion 233 is spaced apart in the first prescribed direction (the direction B1) from the rear end portion of the base portion 282 of the connecting member 280 at the second operating position. Here, a first minimum distance is defined as a minimum distance in an angular rotational direction about the protruding portion 229 from the boss 235 of the moving member 230 at the first operating position to the opposing portion 285 of the connecting member 280 at the second operating position. Further, a second minimum distance is defined as a minimum distance in the angular rotational direction about the protruding portion 229 from the projecting portion 233 of the moving member 230 at the first operating position to the connecting member 280 at the second operating position. The first minimum distance is smaller than the second minimum distance. In this embodiment, the first minimum distance is zero.

3-2. Force Adjustment Operation

Figure 10A:
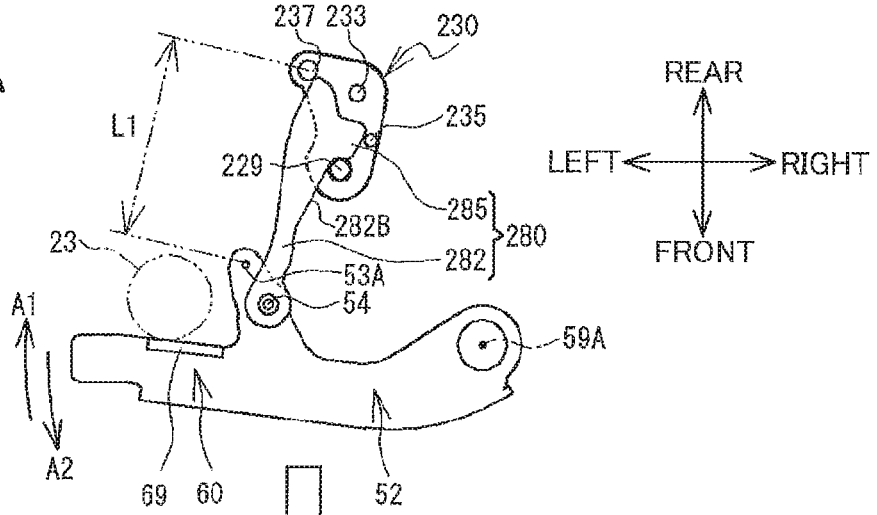
FIGS. 10A through 10C are views illustrating a positional relationship among the support member 52, the moving member 230 and the connecting member 280 when the moving member 230 is pivotally moved from a first operating position to a second urging position via a first urging position.
Figure 10B:
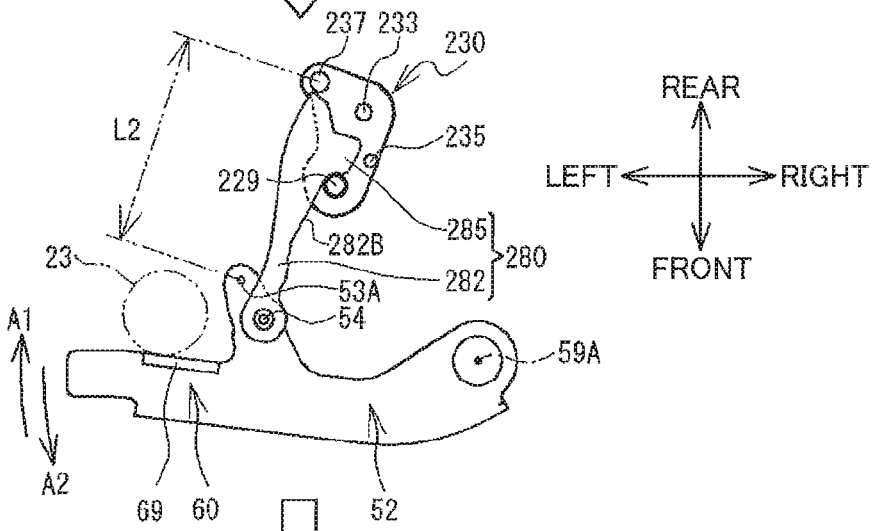
Figure 10C:
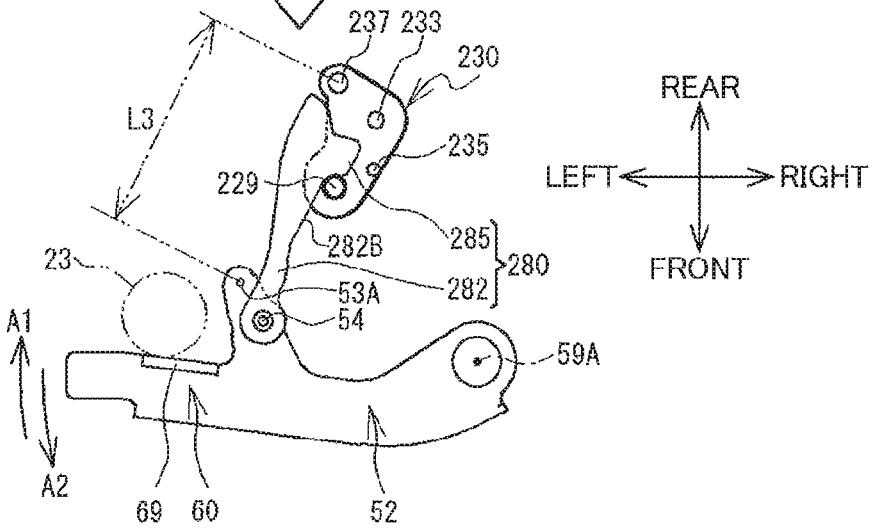
Figure 11A:
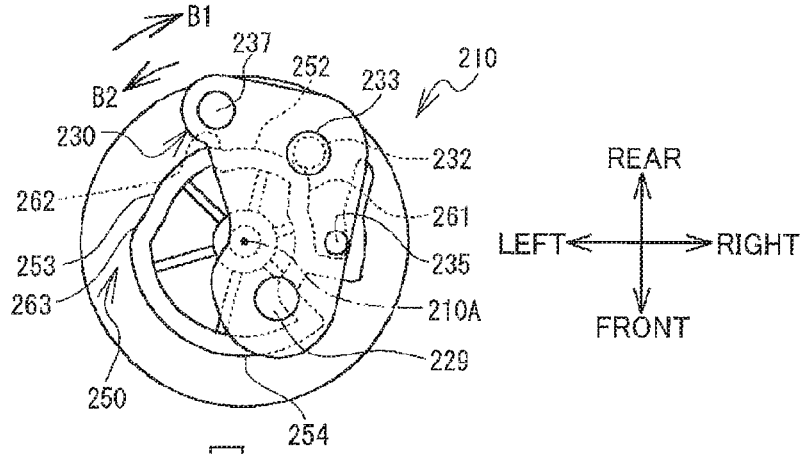
FIGS. 11A through 11C are views illustrating a positional relationship between the moving member 230 and the cam member 210 when the cam member 210 is rotated from the first rotational position to a third rotational position via a second rotational position.

The force adjustment operation will next be described with reference to FIGS. 10A through 12. The user can select one of the "small nipping force", the "intermediate nipping force" and the "large nipping force" by operating the operating portion 17. Upon selection, the printer 1 starts the force adjustment operation. Incidentally, FIGS. 10A, 10B and 10C correspond to FIGS. 11A, 11B and 11C, respectively. Further, a state of the moving member 230 illustrated in FIGS. 10A and 11A is coincident with a state of the moving member 230 illustrated in FIGS. 7D and 8D. A state of the moving member 230 illustrated in FIGS. 10C and 11C is coincident with a state of the moving member 230 illustrated in FIG. 12. In FIG. 10A, the prescribed distance (the dimension L) is represented by "L1" when the moving member 230 is at the first operating position.

Figure 11B:
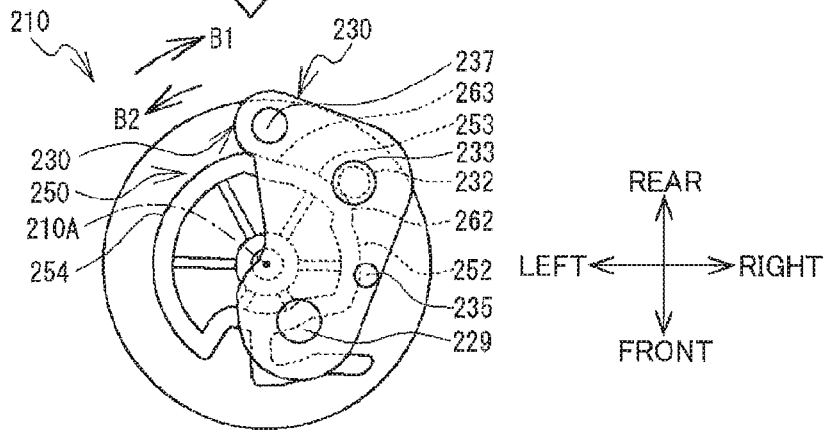
Figure 11C:
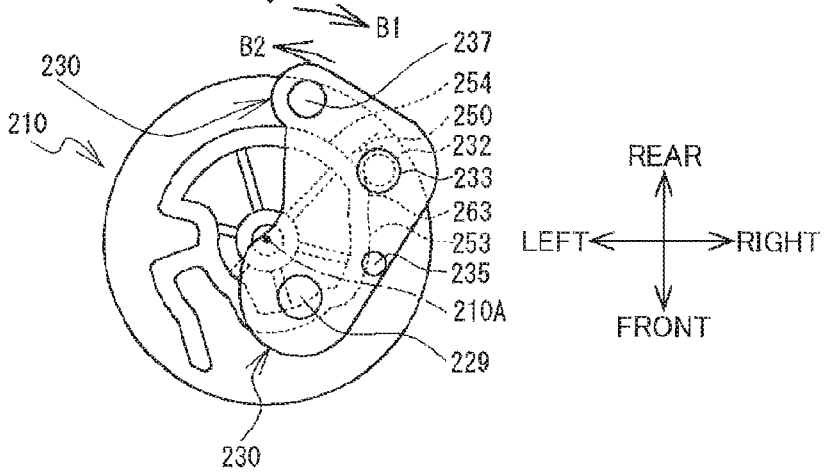

The motor 205 rotates in the forward direction by the control of the CPU (not illustrated) of the board 19, so that the cam member 210 rotates in the clockwise direction in a plan view from the first rotational position (FIGS. 11A and 11B). By the clockwise rotation of the cam member 210, the extension surface 252 and the specific surface 262 are slidingly moved in this order relative to the slide pin 232. Hence, the moving member 230 is pivotally moved in the first prescribed direction (the direction B1) from the first operating position (FIG. 11A).

The platen roller 23 restricts the heater 69 from moving in the first pivotally moving direction (the direction A1), and the protruding portion 229 restricts the specific portion 282B from moving in the clockwise direction in a plan view about the shaft member 54. Accordingly, the nipping position of the support member 52 and the second operating position of the connecting member 280 can be maintained in spite of the pivotal movement of the moving member 230 in the first prescribed direction (the direction B1) from the first operating position (FIGS. 10A, 10B and 10C).

The rotation of the motor 205 in the forward direction is stopped upon rotation of the cam member 210 to a second rotational position (FIG. 11B). The second rotational position is a rotational position of the cam member 210 where a downstream end portion of the extension surface 253 in the clockwise direction in a plan view is in contact with the slide pin 232. The moving member 230 is pivotally moved to a first urging position (FIG. 11B) upon rotation of the cam member 210 to the second rotational position. The first urging position is a position displaced from the first operating position in the first prescribed direction (the direction B1). The prescribed distance (the dimension L) is increased by moving the moving member 230 from the first operating position to the first urging position. In FIG. 10B, the prescribed distance (the dimension L) is represented by "L2" when the moving member 230 is at the first urging position. The prescribed distance L2 is greater than the prescribed distance L1 (FIG. 10A).

That is, the amount of the resilient deformation of the resilient member 201 (FIG. 5) is increased by moving the moving member 230 from the first operating position to the first urging position. The nipping force is greater when the moving member 230 is at the first urging position than when the moving member 230 is at the first operating position.

The motor 205 resumes its forward rotation after the cam member 210 rotates to the second rotational position. By the clockwise rotation of the cam member 210, the extension surface 253 and the specific surface 263 are slidingly moved in this order relative to the slide pin 232. Accordingly, the moving member 230 is further pivotally moved in the first prescribed direction (the direction B1) from the first urging position (FIGS. 11B and 11C).

The rotation of the motor 205 in the forward direction is stopped upon rotation of the cam member 210 to a third rotational position (FIG. 11C). The third rotational position is a rotational position of the cam member 210 where a downstream end portion of the extension surface 254 in the clockwise direction in a plan view is in contact with the slide pin 232. The moving member 230 is pivotally moved to a second urging position (FIGS. 11C and 12) upon rotation of the cam member 210 to the third rotational position. The second urging position is a position displaced from the first urging position in the first prescribed direction (the direction B1). The prescribed distance (the dimension L) is further increased by moving the moving member 230 from the first urging position to the second urging position. In FIG. 10C, the prescribed distance (the distance L) is represented by "L3" when the moving member 230 is at the second urging position. The prescribed distance L3 is greater than the prescribed distance L2 (FIG. 10B).

That is, the amount of the resilient deformation of the resilient member 201 is further increased by moving the moving member 230 from the first urging position to the second urging position. The nipping force is greater when the moving member 230 is at the second urging position than when the moving member 230 is at the first urging position.

The CPU (not illustrated) of the board 19 positions the cam member 210 to one of the first rotational position, the second rotational position, and the third rotational position in accordance with the nipping force selected by the user. For example, when the user selects the "small nipping force", the printer 1 terminates the force adjustment operation without rotating the cam member 210 after the tube nipping operation is terminated. When the user selects the "intermediate nipping force", the printer 1 terminates the force adjustment operation after the cam member 210 is rotated to the second rotational position. When the user selects the "large nipping force", the printer 1 terminates the force adjustment operation after the cam member 210 is rotated to the third rotational position.

3-3. Printing Operation

The printing operation will next be described with reference to FIGS. 2 through 4 and 9. In response to input of a command, by the user, to the operating portion 17 for starting the printing operation, the printer 1 in which the force adjustment operation is completed starts the printing operation.

The drive motor (not illustrated) is rotated by the control of the CPU (not illustrated) of the board 19. In conjunction with the rotation of the drive motor, the platen roller 23, the drive roller 21A, the drive roller 22A, and the ribbon winding shaft 63 are rotated. The rotating platen roller 23, the rotating drive roller 21A, and the rotating drive roller 22A convey the tubular member 9 downstream in the tube conveying direction. Therefore, the bending portion of the tubular member 9 positioned between the platen roller 23 and the two prescribed portions 21C is pulled into a position between the platen roller 23 and the printing surface 69A. In this case, the covering portion 57 and the rotary member 55 are rotated in a counterclockwise direction in a plan view about the shaft member 54. Accordingly, a frictional force generated between the tubular member 9 and the covering portion 57 can be reduced.

In conjunction with the rotation of the ribbon winding shaft 63, the winding spool 300 rotates in a winding direction (in this embodiment, a counterclockwise direction in a plan view). In conjunction with the rotation of the winding spool 300, the ribbon spool 81 rotates along with the rotary detection shaft 71 in a pulled direction (in this embodiment, a counterclockwise direction in a plan view). Thus, the ink ribbon 93 is pulled out of the ribbon spool 81. The pulled-out ink ribbon 93 is conveyed to the outside of the case 101, and is pulled into a position between the printing surface 69A and the tubular member 9 through the right guide portion 65A. As described above, the downstream end portion of the right guide portion 65A in the first pivotally moving direction (the direction A1) is positioned downstream of the printing surface 69A in the first pivotally moving direction (the direction A1). Accordingly, the ink ribbon 93 passing through the right guide portion 65A (that is, the specific ink ribbon 93A) is not likely to be in contact with a right portion of the heater 69 or a downstream corner portion of the heater 69 in the first pivotally moving direction (the direction A1). Consequently, generation of creases in the ink ribbon 93 can be restrained.

The heater 69 generates heat by the control of the CPU (not illustrated). The heater 69 applies heat to the specific ink ribbon 93A to print one of more characters on the tubular member 9. The printing surface 69A prints a normal image of the character(s) on a front portion of the tubular member 9 passing through a rear side of the printing surface 69A.

One of more characters are printed on the portion of the tubular member 9 passing through the communication space 8 and conveyed downstream in the tube conveying direction. The ink ribbon 93 passing a position between the printing surface 69A and the tubular member 9 is wound onto the winding spool 300. The heater 69 stops generating heat after the character(s) is printed on the tubular member 9, and the drive motor (not illustrated) stops rotating. The printer 1 terminates the printing operation.

Incidentally, while the printer 1 properly performs the printing operation, the rotary detection shaft 71 is rotated so that the sensor 73 alternately outputs the ON signal and the OFF signal. Therefore, during the printing operation in the printer 1, the CPU (not illustrated) determines whether the tubular member 9 and the ink ribbon 93 are adequately conveyed by monitoring the signals outputted from the sensor 73.

For example, when conveyance of the tubular member 9 is stopped by an unexpected factor, conveyance of the specific ink ribbon 93A toward the winding spool 300 is restricted in spite of rotation of the ribbon winding shaft 63. Then, rotations of the ribbon spool 81 and the rotary detection shaft 71 are stopped, and the sensor 73 continuously outputs one of the ON signal and the OFF signal. Further, the CPU stops generation of heat in the heater 69, and stops rotation of the drive motor (not illustrated). Hence, rotations of the platen roller 23, the drive roller 21A, and the drive roller 22A are stopped. Consequently, in the printer 1, conveyance failure of the tubular member 9 and the ink ribbon 93 can be detected, and the printing operation can be halted upon detection of the conveyance failure.

Rotation of the ribbon winding shaft 63 does not occur in a state where conveyance of the specific ink ribbon 93A is restricted. Therefore, a portion of the ink ribbon 93 positioned between the printing surface 69A and the winding spool 300 is not stretched in its longitudinal direction due to rotation of the ribbon winding shaft 63. Accordingly, fracturing of the ink ribbon 93 due to conveyance failure of the tubular member 9 and the ink ribbon 93 can be restrained.

3-4. Tube Releasing Operation

The tube releasing operation will next be described with reference to FIGS. 2, 5, 7A through 8D, and 10A through 12. The printer 1 performs the tube releasing operation after completion of the printing operation. The following description is given assuming that the printing operation has been performed in a state where the moving member 230 is at the second urging position.

The motor 205 rotates in the reverse direction by the control of the CPU (not illustrated) of the board 19. As illustrated in FIGS. 10A through 12, the cam member 210 rotates from the third rotational position (FIG. 12) to the first rotational position (FIG. 11A) through the second rotational position (FIG. 11B). In conjunction with the rotation of the cam member 210, the moving member 230 is pivotally moved from the second urging position (FIG. 12) to the first operating position (FIG. 11A) through the first urging position (FIG. 11B). During the rotation of the cam member 210 from the third rotational position to the first rotational position, the support member 52 maintains its nipping position, and the connecting member 280 maintains its second operating position (FIGS. 10C, 10B and 10A). Upon pivotal movement of the moving member 230 from the second urging position to the first operating position, the boss 235 is brought into contact with the opposing portion 285 of the connecting member 280 at the second operating position from a downstream side thereof in the first prescribed direction (the direction B1).

The motor 205 continuously rotates in the reverse direction, so that the cam member 210 rotates from the first rotational position toward the initial rotational position (FIGS. 8D and 8C). In conjunction with the rotation of the cam member 210 from the first rotational position toward the initial rotational position, the moving member 230 is pivotally moved from the first operating position (FIG. 7D) toward the intermediate position (FIG. 7C). In conjunction with the pivotal movement of the moving member 230 from the first operating position toward the intermediate position, the boss 235 urges the opposing portion 285 of the connecting member 280 in the second prescribed direction (the direction B2). Accordingly, the connecting member 280 is pivotally displaced in the counterclockwise direction in a plan view about the shaft member 54 while a front end portion of the opposing portion 285 is slidingly moved relative to the protruding portion 229. The specific portion 282B is moved leftward away from the protruding portion 229. Upon pivotal movement of the moving member 230 to the intermediate position (FIG. 7C), the connecting member 280 is displaced to the rearmost position, and the right end portion of the opposing portion 285 is displaced to a position leftward and rearward of the protruding portion 229. As a result, the connecting member 280 can be moved in a direction opposite to the specific direction (the direction C). In this case, the projecting portion 233 of the moving member 230 is brought into contact with the rear end portion of the base portion 282 of the connecting member 280 from a downstream side thereof in the specific direction (the direction C) (FIG. 7C).

The projecting portion 233 urges the base portion 282 in the direction opposite to the specific direction (the direction C) as a result of the pivotal movement of the moving member 230 from the intermediate position in the second prescribed direction (the direction B2). The connecting member 280 is displaced from the rearmost position toward the second pressure release position (FIGS. 7C, and 7B). In conjunction with the displacement of the connecting member 280 from the rearmost position toward the second pressure release position, the support member 52 is pivotally moved from the nipping position toward the separated position, and the head 60 is pivotally moved from the head-nipping position toward the head-release position. The covering portion 57 is pivotally moved in the second pivotally moving direction (the direction A2) along with the support member 52.

Thereafter, the first wall portion 255A of the cam member 210 urges the slide pin 232 in the counterclockwise direction in a plan view about the second axis 210A (FIGS. 8B and 8A). Therefore, the moving member 230 is pivotally moved to the first pressure release position as a result of the rotation of the cam member 210 to the initial rotational position. The connecting member 280 is displaced to the second pressure release position, the support member 52 is pivotally moved to the separated position, and the head 60 is pivotally moved to the head-separated position. Because the covering portion 57 is moved forward away from the imaginary straight line 18 (FIG. 12), the tubular member 9 positioned between the drive roller 21A and the platen roller 23 extends along the imaginary straight line 18. Thus, the printer 1 terminates the tube releasing operation.

As illustrated in FIG. 2, the user opens the cover 12 relative to the body casing 11 after the tube releasing operation is completed. The user moves the lever 79 from the closed posture to the open posture, so that the follower roller 21B and the follower roller 22B are displaced from the advanced positions to the retracted positions, respectively. As a result, the user can remove the printed tubular member 9 from the tube receiving portion 40.

4. Operational Advantages

According to the above-described embodiment, the support member 52 is moved from the separated position to the nipping position. The tubular member 9 linearly extending between the heater 69 of the head 60 at is head-nipping position and the two prescribed portions 21C is bent rearward relative to the imaginary straight line 18 by the covering portion 57. Therefore, the contacting area of the tubular member 9 relative to the platen roller 23 is increased in comparison with a case where the support member 52 is at the separated position. Because of the increase in the contacting area between the tubular member 9 and the platen roller 23, a conveying force of the platen roller 23 for conveying the tubular member 9 is increased. Accordingly, in the printer 1, conveying performance for conveying the tubular member 9 nipped between the head 60 and the platen roller 23 can be improved. Further, the covering portion 57 can be moved to a position at which the tubular member 9 is bent by only moving the support member 52 to the nipping position. Therefore, the printer 1 can provide a simple construction, and accordingly, the conveying performance to the tubular member 9 nipped between the head 60 and the platen roller 23 can be improved with a simplified structure.

The covering portion 57 covers the outer circumferential surface of the rotary member 55 so as to extend continuously in the circumferential direction. The covering portion 57 that generates bending of the tubular member 9 is rotated together with the rotary member 55 in case where the tubular member 9 is conveyed downstream in the tube conveying direction while a part of the tubular member 9 positioned between the drive roller 21A and the head 60 at the head-nipping position is bent. Therefore, a frictional force generated by the contact of the tubular member 9 with the covering portion 57 can be reduced during conveyance of the tubular member 9. As a result, conveying performance to the tubular member 9 can further be improved in the printer 1.

The covering portion 57 that generates bending of the tubular member 9 receives a reaction force directing forward from the tubular member 9. However, when the connecting member 280 is at the second operating position, the opposing portion 285 faces the protruding portion 229 at a position downstream of the protruding position 229 in the specific direction (the direction C). Hence, the protruding portion 229 restricts the connecting member 280 at the second operating position from being displaced toward the second pressure release position. Consequently, forward movement of the covering portion 57 due to the reaction force from the bending tubular member 9 can be restrained. Accordingly, the tubular member 9 a part of which is bent can be stably conveyed.

The rotation axis 23A of the platen roller 23 is positioned at a rear side relative to the imaginary straight line 18, and the moving member 230 is positioned at the rear side relative to the imaginary straight line 18. In other words, the moving member 230 is positioned remote from components that are positioned at a front side relative to the imaginary straight line 18. The components positioned at the front side relative to the imaginary straight line 18 includes a rotation shaft, and a gear member for connecting the ribbon winding shaft 63 and the drive motor (not illustrated), for example. Thus, the printer 1 can simplify its configuration.

The connecting wall portion 53 of the support member 52 is positioned farther away from the first axis 59A than the covering portion 57 from the first axis 59A. With this structure, forward displacement of the covering portion 57 due to the reaction force from the bending tubular member 9 against the resilient force of the resilient member 201 can be restrained. Thus, conveyance of the bending tubular member 9 can further be stabilized.

In case where the moving member 230 is pivotally moved from the first operating position to the first pressure release position, the boss 235 moves the opposing portion 285 to a position further leftward than the protruding portion 229 in the left-right direction. This arrangement permits the pivotal movement of the connecting member 280 from the second operating position to the second pressure release position. Thus, the printer 1 can perform, with a simple structure, switching between a state where displacement of the connecting member 280 toward the second pressure release position is restricted and a state where displacement of the connecting member 280 toward the second pressure release position is permitted.

As described above, the first minimum distance is smaller than the second minimum distance. As described earlier, the first minimum distance is a minimum distance in the angular rotational direction about the protruding portion 229 from the boss 235 of the moving member 230 at the first operating position to the opposing portion 285 of the connecting member 280 at the second operating position, and the second minimum distance is a minimum distance in the angular rotational direction about the protruding portion 229 from the projecting portion 233 of the moving member 230 at the first operating position to the connecting member 280 at the second operating position. Therefore, the projecting portion 233 urges the base portion 282 of the connecting member 280 toward the second pressure release position after the boss 235 urges the opposing portion 285 in the second prescribed direction (B2) to allow the connecting member 280 to be displaced toward the second pressure release position. Accordingly, the displacement of the connecting member 280 from the second operating position to the second pressure release position can be stabilized.

The slide pin 232 of the moving member 230 is slidingly moved relative to the extension surface 252, the specific surface 262, and the extension surface 253 by rotating the cam member 210 between the first rotational position and the second rotational position. With this configuration, the nipping force can be adjusted by the pivotal movement of the moving member 230 between the first operating position and the first urging position. Because a pressing force of the heater 69 against the tubular member 9 is adjusted, printing quality such as density of the character(s) printed on the tubular member 9 can be adjusted.

The extension surfaces 252 and 253 extend in the rotational direction about the second axis 210A. Therefore, the extension surface 252 and 253 can provide stabilized contact with the slide pin 232 even if the rotationally stopping position of the cam member 210 is varied during repeated rotation of the cam member 210 between the first rotational position and the second rotational position. That is, the slide pin 232 can be in contact with the extension surface 253 in a stabilized manner even if the rotation of the cam member 210 is stopped at a position displaced in a clockwise direction in a plan view from the rotational position illustrated in FIG. 11B when the cam member 210 is rotated from the first rotational position toward the second rotational position. Similarly, the slide pin 232 can be in contact with the extension surface 252 in a stabilized manner even if the rotation of the cam member 210 is stopped at a position displaced in a clockwise direction in a plan view from the rotational position illustrated in FIG. 11A when the cam member 210 is rotated from the second rotational position toward the first rotational position. With this arrangement, the pivotally moving position of the moving member 230 is unlikely varied because the distance between the slide pin 232 and the second axis 210A can be stabilized irrespective of variation in the rotational position of the cam member 210. As a result, variation in the nipping force can be restrained.

When the support member 52 is moved to the nipping position, the covering portion 57 approaches the platen roller 23 so that the portion of the tubular member 9 extending along the imaginary straight line 18 approaches the platen roller 23. With this arrangement, the tubular member 9 bent by the covering portion 57 can provide an increased contacting area relative to the platen roller 23. Consequently, conveying performance to the tubular member 9 can further be improved.

The covering portion 57 is positioned away from and forward of the imaginary straight line 18 when the support member 52 is at the separated position. This facilitates attachment of the tubular member 9 into the tube receiving portion 40 by the user.

The tubular member 9 is nipped between the drive roller 21A and the follower roller 21B at a position upstream of the head 60 at the head-nipping position in the tube conveying direction. With this arrangement, the position of the tubular member 9 in the depthwise direction of the tube receiving portion 40 and the widthwise direction of the tube receiving portion 40 is fixed. The drive roller 21A and the follower roller 21B are a pair of rollers that faces each other with the imaginary straight line 18 interposed therebetween. Thus, the tubular member 9 bent by the covering portion 57 can further be conveyed in a stabilized manner.

The tubular member 9 is an example of a printing medium. The head moving portion 200 is an example of a moving mechanism. The drive roller 21A and the follower roller 21B are an example of a positioning member. The movement path 99 is an example of a prescribed path. The covering portion 57 is an example of a displaceable member. The motor 205 is an example of a driving portion. The connecting portion 237 is an example of a first connecting portion. The connecting wall portion 53 is an example of a second connecting portion. The boss 235 is an example of a first projection. The projecting portion 233 is an example of a second projection. The slide pin 232 is an example of a third projection. The sliding surface 250 is an example of a cam surface. The extension surface 252 is an example of a first cam surface. The extension surface 253 is an example of a second cam surface. The specific surface 262 is an example of a third cam surface. The vertical direction is an example of a prescribed direction.

Various modifications are conceivable. For example, in the printer 1, a sheet-like tape may be printed instead of the tubular member 9. Further, the movement of the moving member 230 to the first urging position and the second urging position is not required as long as the movement of the moving member 230 between the initial rotational position and the first operating position can be performed.

The covering portion 57 may not be positioned forward of the imaginary straight line 18 when the support member 52 is at the separated position. Instead, the rear portion of the covering portion 57 may be positioned rearward of the imaginary straight line 18 when the support member 52 is at the separated position. Even in this case, the covering portion 57 is moved rearward by the movement of the support member 52 from the separated position to the nipping position. With this arrangement, the tubular member 9 can be bent by the covering portion 57.

A contact wall portion contactable with the tubular member 9 may be provided at a position between the first conveying portion 21 and the heater 69 of the head 60 at the head-separated position. Such a contact wall portion may be provided integrally with the tube receiving portion 40. In this case, the tubular member 9 attached to the tube receiving portion 40 is fixed in position in the depthwise direction and the widthwise direction of the tube receiving portion 40 upon contacting the contact wall portion. A portion of the tubular member 9 positioned between the contact wall portion and the heater 69 of the head 60 at the head-nipping position extends linearly. Thereafter, the support member 52 is moved from the separated position to the nipping position.

The covering portion 57 bends the linearly extending portion of the tubular member 9 rearward. According to this modification, the contact wall portion is an example of a positioning member.

While the description has been made in detail with reference to the embodiment(s) thereof, it would be apparent to those skilled in the art that many modifications and variations may be made therein without departing from the spirit of the disclosure.

What is claimed is:

1. A printer comprising:

a head configured to print one or more characters on a printing medium;

a platen roller configured to nip the printing medium in cooperation with the head to convey the printing medium in a conveying direction;

a support member supporting the head;

a moving mechanism configured to move the support member between a nipping position and a separated position, the support member at the nipping position allowing the head to nip the printing medium in cooperation with the platen roller, the support member at the separated position allowing the head to be positioned farther from the platen roller than the head from the platen roller at the nipping position, the moving mechanism comprising:

a driving portion configured to generate a driving force;

a moving member including a first connecting portion connected to the support member through a resilient member that is resiliently deformable, the moving member being configured to move from a first pressure release position to a first operating position upon receipt of the driving force from the driving portion to move the support member from the separated position to the nipping position, the first connecting portion increasing an amount of resilient deformation of the resilient member in association with change in position of the moving member from the first pressure release position to the first operating position, the moving member at the first operating position urging the head toward the platen roller;

a protruding portion protruding from the moving member in a prescribed direction; and a connecting member connecting the support member and the protruding portion and configured to move in a specific direction from a second pressure release position to a second operating position in conjunction with a movement of the moving member from the first pressure release position to the first operating position, the connecting member having an opposing portion, the opposing portion facing the protruding portion at a position downstream of the protruding portion in the specific direction;

a positioning member positioned upstream relative to the platen roller in the conveying direction, the positioning member having a prescribed portion configured to contact the printing medium conveyed and nipped between the head and the platen roller, the positioning member being configured to fix a position of the printing medium with respect to a perpendicular direction that is perpendicular to the conveying direction, the prescribed portion and the head providing an imaginary straight line extending therebetween when the head is at a position that nips the printing medium in cooperation with the platen roller; and a displaceable member supported by the support member and configured to move along a prescribed path in conjunction with a movement of the support member between the nipping position and the separated position, the prescribed path intersecting the imaginary straight line.

2. The printer according to claim 1, wherein the platen roller has a rotation axis about which the platen roller is rotatable, the printer further comprising:

a shaft member provided at the support member and extending in parallel to the rotation axis; and a rotary member rotatably provided at the shaft member, and wherein the displaceable member covers an outer circumferential surface of the rotary member so as to continuously extend in a circumferential direction of the rotary member.

3. The printer according to claim 1, wherein the moving member and a rotation axis of the platen roller are positioned on a same side relative to the imaginary straight line.

4. The printer according to claim 1, wherein the support member includes a second connecting portion connected to the resilient member, the support member being configured to pivotally move about a first axis extending in parallel to a rotation axis, wherein the moving mechanism is configured to pivotally move the support member between the nipping position and the separated position, and wherein the second connecting portion is positioned farther away from the first axis than the displaceable member from the first axis.

5. The printer according to claim 1, wherein the protruding portion pivotally movably supports the moving member, wherein the driving portion is configured to pivotally move the moving member about the protruding portion, wherein the connecting member is pivotally movably connected to the support member, the connecting member being configured to slidingly contact the protruding portion, and wherein the moving member pivotally moves about the protruding portion in a first prescribed direction from the first pressure release position to the first operating position, the moving member comprising:

a base portion having a portion opposing the connecting member in the prescribed direction, the base portion being pivotally movably supported by the protruding portion; and a first projection protruding from the base portion in the prescribed direction, the first projection facing the opposing portion at a position downstream of the opposing portion in the first prescribed direction when the connecting member is at the second operating position.

6. The printer according to claim 5, wherein the moving member further comprises a second projection protruding from the base portion in the prescribed direction, the second projection facing the connecting member at a position downstream of the connecting member in the first prescribed direction when the connecting member is at the second operating position, the second projection contacting the connecting member at the second pressure release position at a position downstream of the connecting member at the second pressure release position in the specific direction when the moving member at the first operating position pivotally moves in a second prescribed direction that is opposite to the first prescribed direction, wherein the first projection of the moving member at the first operating position and the opposing portion of the connecting member at the second operating position defines a first minimum distance therebetween in the first prescribed direction about the protruding portion, and wherein the second projection of the moving member at the first operating position and the connecting member at the second operating position defines a second minimum distance therebetween in the first prescribed direction about the protruding portion, the first minimum distance being smaller than the second minimum distance.

7. The printer according to claim 5, wherein the moving member further comprises a third projection protruding from the base portion in a direction opposite to the prescribed direction at a position separated from the protruding portion, wherein the moving mechanism further comprises a cam member configured to rotate about a second axis upon receipt of the driving force, the second axis extending in the prescribed direction at a position between the third projection and the protruding portion, the cam member having a cam surface configured to slidingly contact the third projection of the moving member at the first operating position, and wherein the cam surface includes:

a first cam surface;

a second cam surface positioned farther from the second axis than the first cam surface from the second axis; and a third cam surface connecting the first cam surface and the second cam surface.

8. The printer according to claim 7, wherein the cam member is configured to rotate in a rotation direction about the second axis, the first cam surface and the second cam surface extending in parallel to the rotation direction.

9. The printer according to claim 1, wherein the displaceable member approaches the platen roller when the support member is moved from the separated position to the nipping position.

10. The printer according to claim 1, wherein the displaceable member is separated from the imaginary straight line when the support member is at the separated position.

11. The printer according to claim 1, wherein the positioning member comprises a pair of rollers that is configured to nip the printing medium therebetween to convey the printing medium.

* * * * *